FIP7811 XR 4,043,595

United States Patent [19]

French

[11] 4,043,595

[45] Aug. 23, 1977

[54] IN SITU RECOVERY OF SHALE OIL

[75] Inventor: Gordon B. French, Rifle, Colo.

[73] Assignee: Occidental Oil Shale, Inc., Grand Junction, Colo.

[21] Appl. No.: 603,704

[22] Filed: Aug. 11, 1975

Related U.S. Application Data

[63] Continuation-in-part of Ser. No. 505,276, Sept. 12, 1974, abandoned, and Ser. No. 505,363, Sept. 12, 1974, and Ser. No. 505,457, Sept. 12, 1974, abandoned.

[51] Int. Cl.[2] ..... E21B 43/24; E21B 43/26; F21C 41/10

[52] U.S. Cl. ..... 299/2; 102/23; 166/259; 299/13

[58] Field of Search ..... 299/2, 13; 166/256, 166/299, 302, 303; 102/22, 23

[56] References Cited

U.S. PATENT DOCUMENTS

| | | | |
|---|---|---|---|
| 1,919,636 | 7/1933 | Karrick | 299/2 |
| 2,481,051 | 9/1949 | Uren | 299/2 |
| 2,761,663 | 9/1956 | Gerdetz | 299/2 |
| 3,434,757 | 3/1969 | Prats | 299/2 |
| 3,466,094 | 9/1969 | Hanorth et al. | 299/13 |
| 3,537,753 | 11/1970 | Arendt | 299/13 X;2 |
| 3,611,933 | 10/1971 | Lanning | 166/299 X |
| 3,661,423 | 5/1972 | Garret | 299/2 |
| 3,687,075 | 8/1972 | Fritz | 102/23 |
| 3,877,373 | 4/1975 | Bergman et al. | 299/13 X |
| 3,903,799 | 9/1975 | Walker | 102/23 |

OTHER PUBLICATIONS

E. I. Du Pont de Nemours & Co., Blasters ' Handbook; (1969), 15th edition; pp. 93–96, and 258–272.

Cummins et al., Society of Mining Engineers, SME Mining Engineering Handbook; (1973), pp. 10–37 – 10–45.

*Primary Examiner*—Stephen J. Novosad
*Assistant Examiner*—George A. Suchfield
*Attorney, Agent, or Firm*—Christie, Parker & Hale

[57] ABSTRACT

An in situ oil shale retort is formed in a subterranean oil shale deposit by excavating a columnar void having a vertically extending free face, drilling blasting holes adjacent to the columnar void and parallel to the free face, loading the blasting holes with explosive, and detonating the explosive in a single round to expand the shale adjacent to the columnar void toward the free face in layers severed in a sequence progressing away from the free face and to fill with fragmented oil shale the columnar void and the space in the in situ retort originally occupied by the expanded shale prior to the expansion. A room having a horizontal floor plan that coincides approximately, with the horizontal cross section of the retort to be formed is excavated so as to intersect the columnar void. The blasting holes are drilled and loaded with explosive from the room. The room can lie above the columnar void, below the columnar void, or intermediate the ends of the columnar void. In one embodiment, the columnar void is cylindrical and the blasting holes are arranged in concentric rings around the columnar void. In another embodiment, the columnar void is a slot having one or more large parallel, planar vertical free faces, toward which the oil shale in the retort under construction can be explosively expanded. The blasting holes are arranged in planes parallel to these faces. The resulting retort generally has a cross section coinciding with the placement of the blasting holes and a height determined for the greater part by the vertical height of the columnar void. To form a retort having a large cross-sectional area, a plurality of columnar voids can be excavated and the shale in the retort expanded toward the respective columnar voids to form a continuous fragmented permeable mass of oil shale.

111 Claims, 23 Drawing Figures

LEVEL "A"

LEVEL "B"

LEVEL "C"

Fig. 19
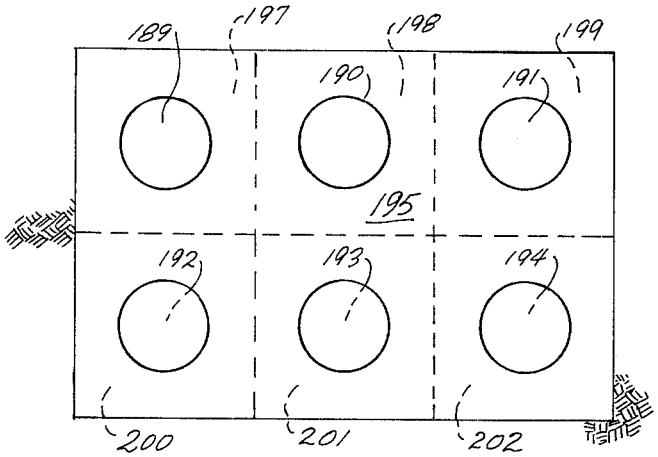
Fig. 20
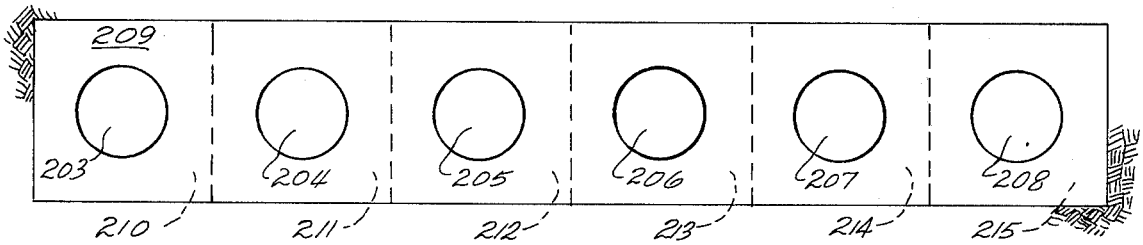
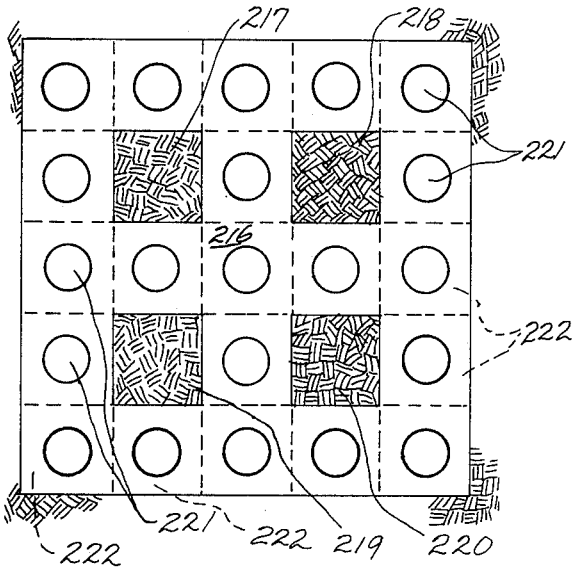
Fig. 21A
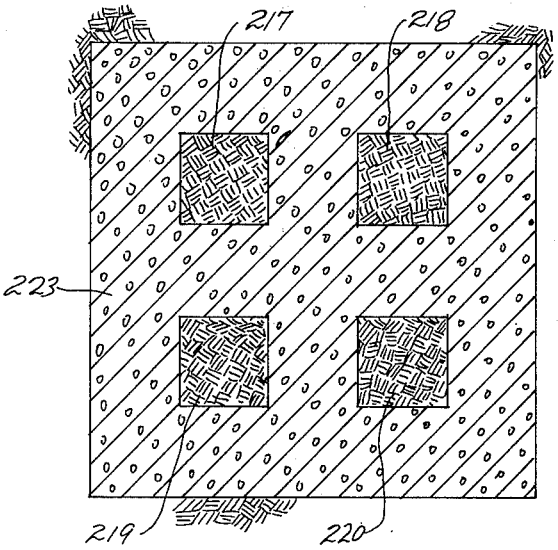
Fig. 21B

IN SITU RECOVERY OF SHALE OIL

CROSS REFERENCE TO RELATED APPLICATIONS

This application is a continuation-in-part of applications Ser. No. 505,276, abandoned, Ser. No. 505,363, and Ser. No. 505,457, abandoned, filed Sept. 12, 1974, the disclosures of which are incorporated herein by reference.

BACKGROUND OF THE INVENTION

This invention relates to the recovery of liquid and gaseous products from oil shale. The term "oil shale" as used in the industry is in fact a misnomer; it is neither shale nor does it contain oil. It is a formation comprising marlstone deposit interspersed with layers of an organic polymer called 37 kerogen" which upon heating decomposes to produce carbonaceous liquid and gaseous products. It is the deposit containing kerogen that is called "oil shale" herein, and the liquid product is called "shale oil."

One technique for recovering shale oil is to set up a retort in a subterranean oil shale deposit. The shale within the retort is fragmented and the shale at the top of the retort is ignited to establish a combustion zone. An oxygen containing gas is supplied to the top of the retort to sustain the combustion zone, which proceeds slowly down through the fragmented shale in the retort. As burning proceeds, the heat of combustion is transferred to the shale below the combustion zone to release shale oil and gases therefrom in a retorting zone. Thus, a retorting zone moves from top to bottom of the retort in advance of the combustion zone, and the resulting shale oil and gases pass to the bottom of the retort for collection.

In preparation for the described retorting process, it is important that the shale be fragmented, rather than simply fractured, in order to create high permeability; otherwise, too much pressure is required to pass the gas through the retort. Known methods of creating such high shale permeability call for mining large volumes of the oil shale prior to fragmentation. This is objectionable in two respects. First, mining the shale and transporting it to the ground level are expensive operations. Second, the mined shale is excluded from the in situ retorting process, thus reducing the overall recovery of shale oil from the retort.

SUMMARY OF THE INVENTION

An in situ retort in a subterranean formation containing oil shale is formed by excavating a columnar void having a vertically extending free face, leaving adjacent to the free face a portion of oil shale to be fragmented in the formation, and then filling the columnar void and the space occupied by the adjacent portion with fragmented shale by explosively expanding the adjacent portion of shale toward the columnar void with a single round of explosions in a plurality of layers of oil shale that are parallel to the free face and severed in a sequence progressing away from the free face.

BRIEF DESCRIPTION OF THE DRAWINGS

The features of specific embodiments of the best mode contemplated of carrying out the invention are illustrated in the drawings, in which:

— FIGS. 1 and 3 are bottom sectional views through a plane indicated in FIG. 2, and FIG. 2 is a side sectional view through a plane indicated in FIG. 1;

— FIG. 5 is a side sectional view through a plane indicated in FIGS. 6 and 7, and FIGS. 6, 7, and 8 are top sectional views through planes indicated in FIG. 5;

— FIG. 11 is a side sectional view through a plane indicated in FIG. 13, FIGS. 12A and 12B are side sectional views through planes indicated in FIG. 13, and FIG. 13 is a top sectional view through a plane indicated in FIG. 11;

— FIGS. 14, 15 and 16 are top sectional views taken through three different levels of the deposit;

— FIG. 17 is a side sectional view through a plane indicated in FIG. 18, and FIG. 18 is a bottom sectional view through a plane indicated in FIG. 17; and FIGS. 19, 20 and 21A are top sectional views depicting other embodiments in which a plurality of columnar voids are used with a single room to fragment a retort, and FIG. 21B is a bottom sectional view of the embodiment of FIG. 21A after fragmentation.

DETAILED DESCRIPTION OF THE SPECIFIC EMBODIMENTS

Summary of Contents

Figure 13:
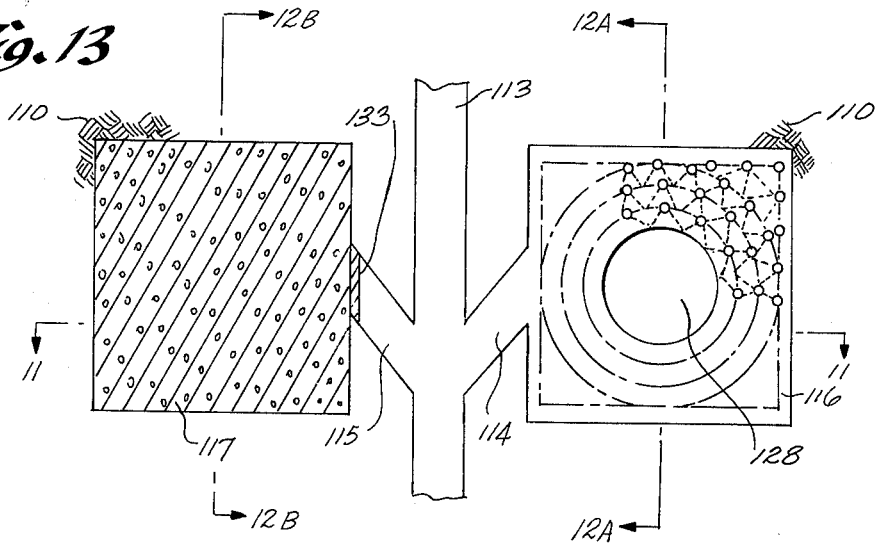
FIGS. 11 through 13 depict another portion of an oil shale seam in which a room employed to prepare a retort for fragmentation is located intermediate the ends of a columnar void
Figure 14:
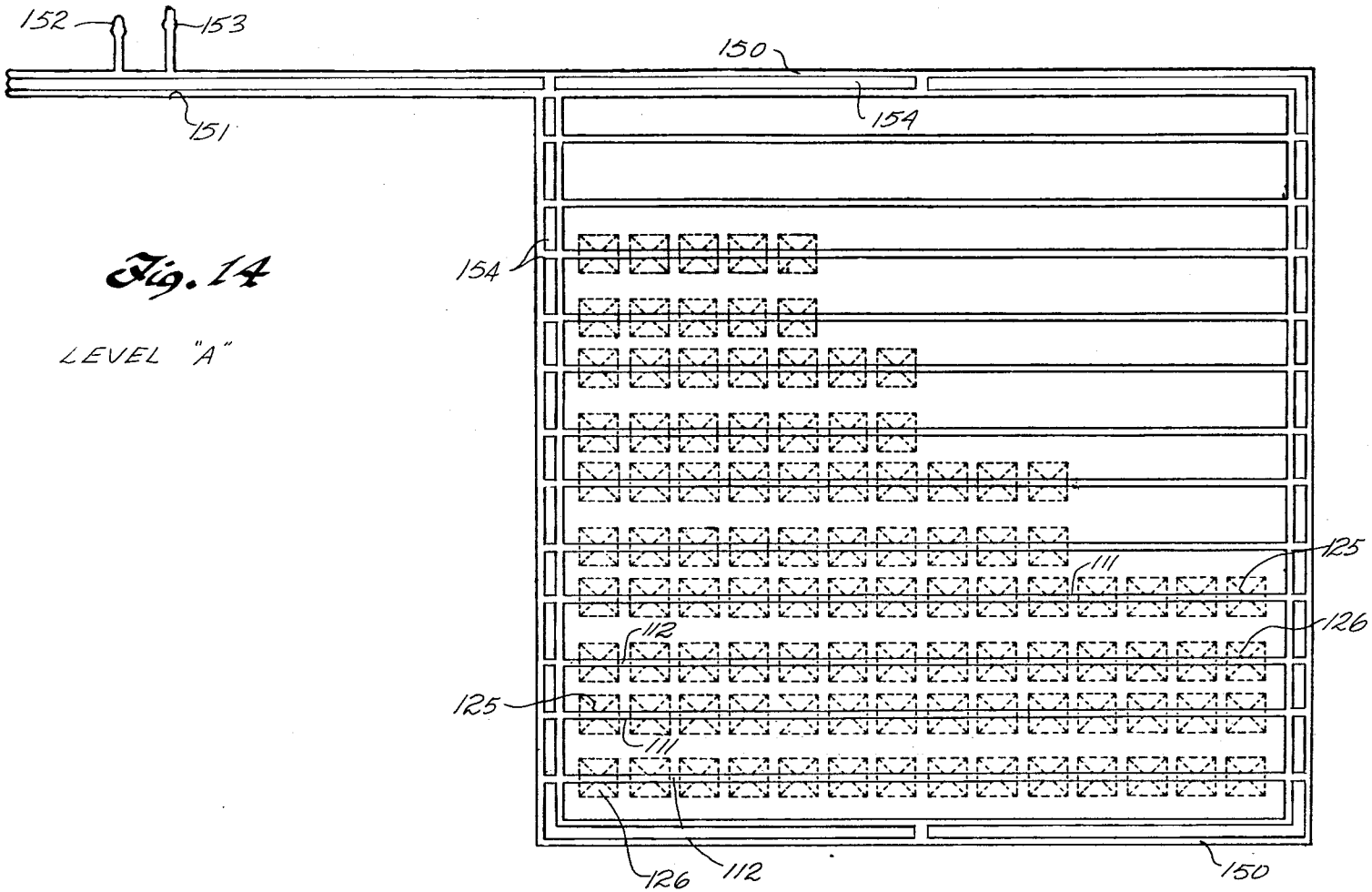
FIGS. 14 through 16 depict the portion of the seam in FIGS. 11 through 13 as part of an overall mining plan for commercial scale operations
Figure 15:
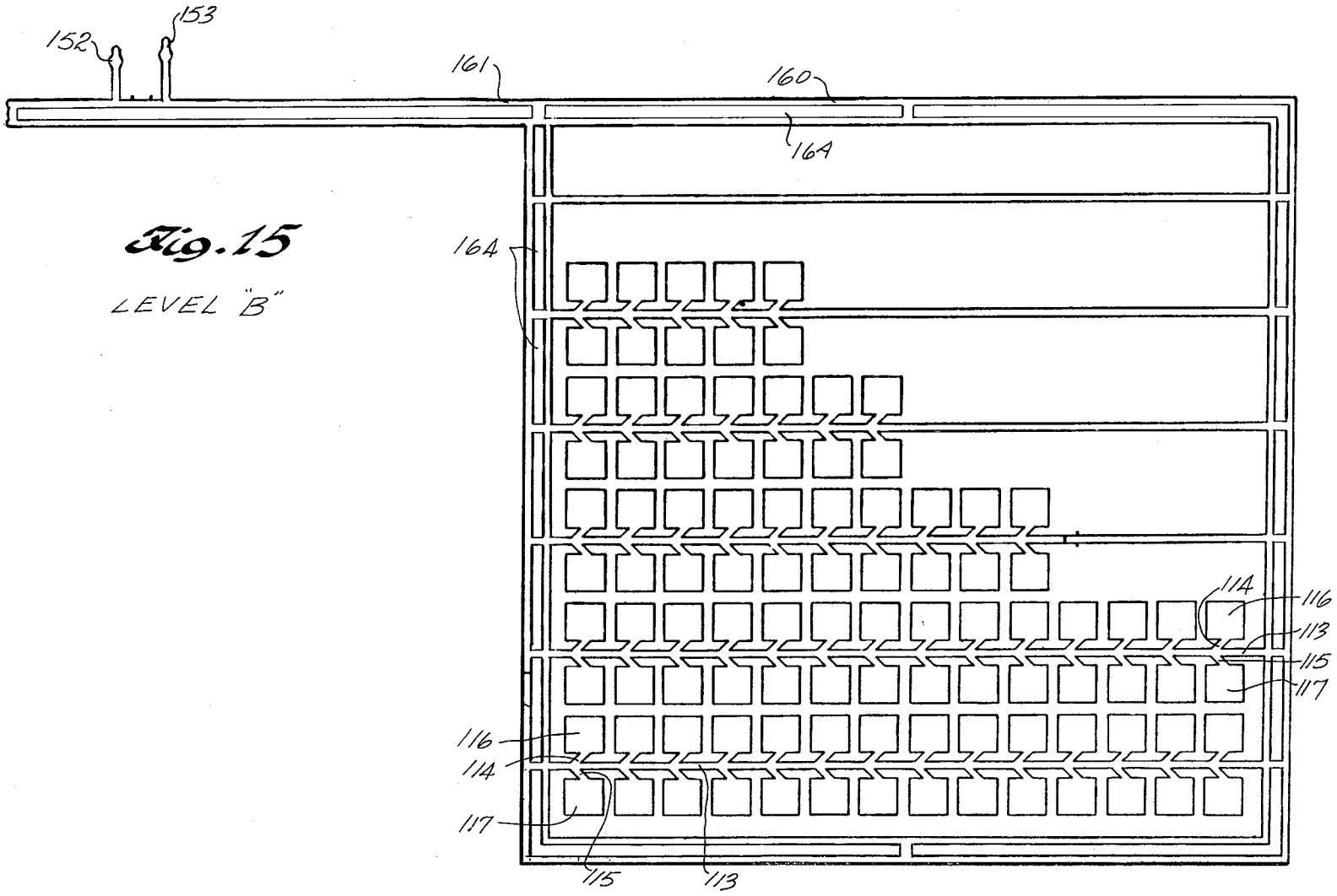
Figure 16:
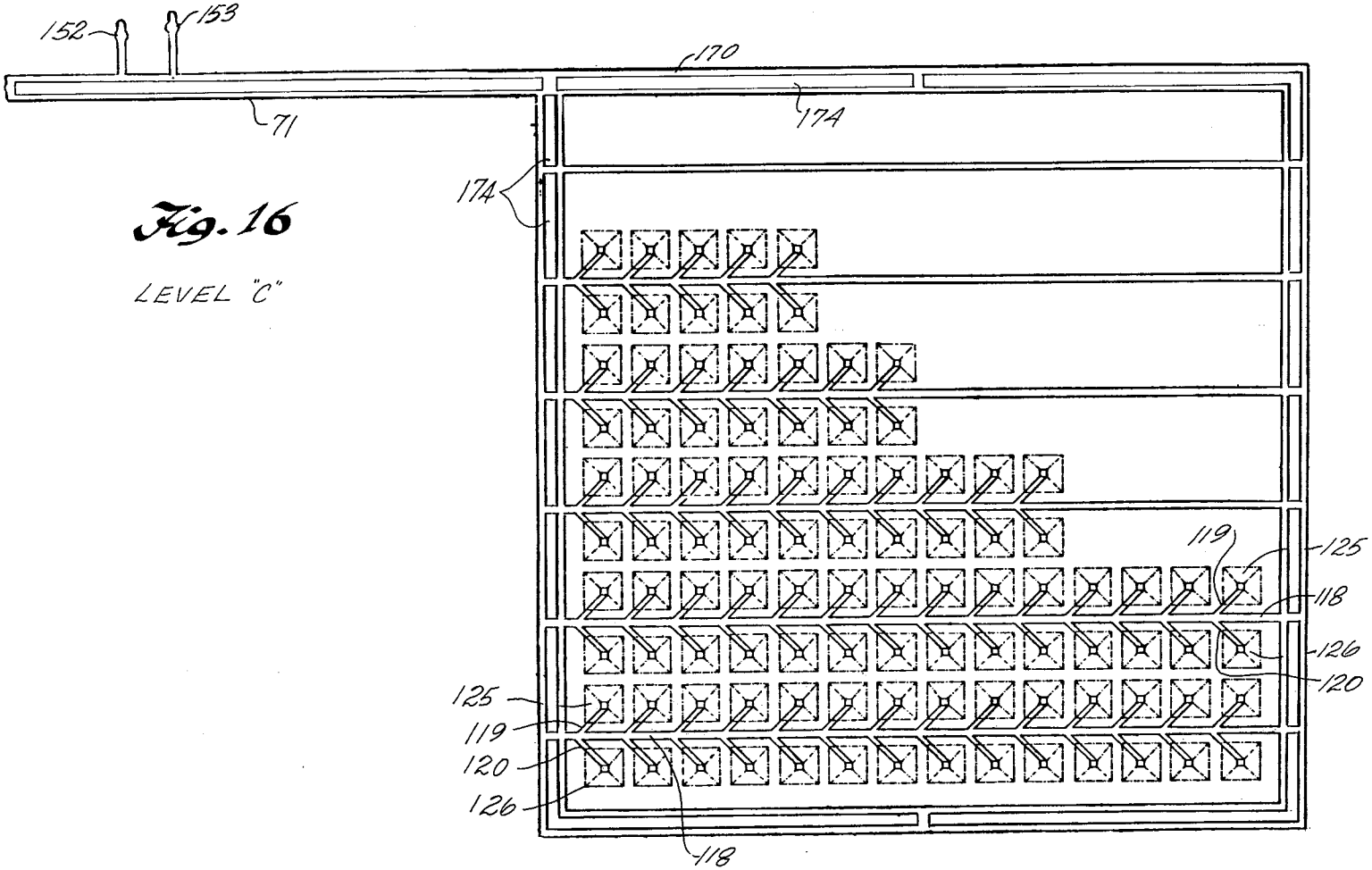

I. General Discussion of Invention
II. Formation of Retort by Multi-Directional Expansion
  A. Excavation of Cylindrical Columnar Void
    1. Vertical Increments
    2. Lateral Increments (FIG. 3)
  B. Blasting to Columnar Void (FIGS. 1,2)
  C. Retorting (FIG. 4)
III. Formation of Retort by One-Directional Expansion Toward a Free Face (FIGS. 5–8)
  A. Excavation of Slot-Shaped Columnar Voids
  B. Blasting to Slots
IV. Position of Columnar Void
  A. Above Room (FIGS. 1,2)
  B. Below Room (FIGS. 9, 10)
  C. Above and Below Room (FIGS. 11–13)
V. Techniques for Preparing Large Regions A. Plural Retorts and Interconnecting Tunnels (FIGS. 14–16)

B. Plural Columnar Voids Extending from Single Room (FIGS. 17–21)

I. General Discussion of Invention

A retort in a subterranean formation containing oil shale, having top, bottom and side boundaries of unfragmented formation, is formed by excavating a first portion of the oil shale from within such boundaries to form at least one columnar void, the surface of the formation which defines the columnar void presents at least one free face that extends vertically through the subterranean oil shale deposit, and leaves a second portion of the formation, which is to be fragmented by expansion toward the columnar void, within the boundaries of the retort and extending away from a free face. The second portion is explosively expanded toward the columnar void in one or more segments, including at least one layer of formation parallel to a free face. The expansion of the oil shale toward the columnar void fragments the oil shale thereby distributing the void volume of the columnar void throughout the retort.

The columnar void can be formed by any of a number of methods, including excavation procedures useful for forming shafts, raises and winzes. Burn cutting rounds, angle cutting rounds, or combinations of angle cutting and burn cutting rounds are useful for forming the columnar void.

Placement of the explosive for expanding the oil shale toward the free face of the columnar void is preferably accomplished by drilling blasting holes through the oil shale adjacent to the columnar void and parallel to the free face and loading the blasting holes with the explosive.

The columnar void may have any desired cross-sectional shape. In one embodiment, the columnar void is vertical and cylindrical providing a cylindrical free face spaced from the side boundaries of the retort to be formed; the blasting holes are arranged in one or more concentric rings around the columnar void to expand the shale within the rings multi-directionally toward the free face upon detonation of the explosive.

The columnar void extends vertically for the greater part of the height of the retort to be formed. However, the height of the columnar void can exclude the portion of the height of the retort to be formed attributable to work rooms, any pillar separating a work room from a columnar void, and any other portion of the height of the retort being formed from which the shale is blasted to a horizontal free face, such as a dome-shaped portion at the top boundary. In any case, the height of the columnar void would usually be greater than three-quarters of the height of the retort.

The explosive used for expanding the oil shale toward the longitudinal axis or plane of the columnar void is detonated in an outwardly progressing sequence such that the oil shale adjacent to the columnar void is expanded toward the free face of the columnar void and the remainder of the explosive in the retort is detonated before the expanded oil shale adjacent to the columnar void falls appreciably due to the force of gravity.

The general art of blasting rock deposits is discussed in *The Blasters' Handbook,* 15th Edition, published by E. I. duPont de Nemours & Company, Wilmington, Delaware.

The location of the base of operation or work area from which the blasting holes are drilled and loaded with explosive can be located within or external to the boundaries of the retort to be formed. The base of operation can be one or more tunnels lying either outside or within the retort to be formed. Usually, however, the base of operation is a room lying within the space in which the retort is to be formed. The room has a floor plan that coincides approximately with the horizontal cross section of the retort to be formed and lies in a plane extending approximately perpendicular to the free face of the columnar void to provide unlimited access to the region adjacent to the columnar void for drilling and explosive loading equipment. This room can be at the upper boundary of the retort, the lower boundary of the retort, or at intermediate levels between the upper and lower boundaries of the retort. There can also be more than one base of operation along the height of the columnar void from which blasting holes are drilled and loaded.

The distributed void fraction of the retort, i.e., the ratio of the void volume to the total volume in the retort, is controlled by selecting the horizontal cross-sectional area of the columnar void or voids. The horizontal cross-sectional area of the columnar void or voids is sufficiently small compared to the horizontal cross-sectional area of the retort that the expanded shale is capable of filling the columnar void or voids and the space occupied by the expanded shale prior to detonation of the explosive. In other words, the horizontal cross-sectional area of the columnar void or voids is not so large that the expanded shale occupies less than the entire space of the columnar void or voids and the space occupied by the expanded shale prior to detonation of the explosive. Thus, remote from the work rooms, the shale in a horizontal slice of the retort along the height of a columnar void, i.e., a segment between two horizontal planes, moves essentially toward the columnar void without moving appreciably upwardly or settling downwardly. This promotes a more uniform permeability and distribution of void volume along the height of retort, because remote from the work rooms there is no appreciable vertical displacement of the fragmented shale. In filling a columnar void and the space occupied by the expanded shale prior to detonation, the particles of the expanded shale become jammed and wedged together tightly so they do not shift or move after fragmentation has been completed. In numerical terms, the horizontal cross-sectional area of the columnar void should be less than about 40% of the horizontal cross-sectional area of the retort in order to fill the columnar void and the space occupied by the expanded shale prior to detonation. In one embodiment of this invention, the horizontal cross-sectional area of the columnar void is preferably not greater than about 20% of the cross-sectional area of the retort, as this is found to provide a void volume in the fragmented oil shale adequate for satisfactory retorting operation.

The horizontal cross-sectional area of the columnar void is also sufficiently large compared to the horizontal cross-sectional area of the retort so that substantially all of the expanded shale within the retort is capable of moving enough during explosive expansion to fragment and for the fragments to reorient themselves. If the horizontal cross-sectional area of the columnar void is too small, a significant quantity of the shale within the retort volume can fracture without fragmenting. If the shale fractures without fragmenting, as when the space for explosive expansion of the shale is insufficient, fissures can be formed and the shale frozen in place without fragmentation. The void volume in fractured (but not fragmented) shale is neither large enough nor suitably distributed for efficient in situ retorting, and the permeability is too small to provide the prescribed gas flow rate through the retort at a reasonable pressure.

When the fragmented shale particles are later retorted, they increase in size. Part of this size increase is temporary and results from thermal expansion, and part is permanent and is brought about during the release of kerogen from the shale. The void volume of the fragmented shale should also be large enough for efficient in situ retorting as this size increase occurs. In numerical terms, the minimum average horizontal cross-sectional area of the columnar void in view of the above considerations should be above about 10% of the horizontal cross-sectional area of the retort. Below this average percentage value, an undesirable amount of power is required to drive the gas blowers and compressors supplying the retorting gas to the retort.

Within the range of 10% to 20%, the especially preferred horizontal cross-sectional area for the columnar void is about 15% of the horizontal cross-sectional area of the retort. The data collected to date from work in the Piceance Basin of Colorado indicate this value provides a good balance among the various characteristics of the retort, i.e., void volume, permeability, and particle size, without having to excavate excessive amounts of shale to form the columnar void. For example, a retort having a height of about 100 feet can require a pressure drop of less than about 1 psi from top to bottom for vertical movement of a mixture of air and off gas down through the retort at about 1 to 2 standard cubic feet per minute (scfm) per square foot of horizontal cross section of the retort, while retorts having greater heights would require proportionally larger pressure drops. Thus, an adequate gas flow rate through retorts up to 1000 feet in height can be provided with a pressure drop of less than 10 psi from top to bottom. In some areas of the Piceance Basin, a gas pressure of greater than 10 psi is objectionable because it results in excessive gas leakage into the intact shale around the retort.

The above percentage values assume that all the shale within the boundaries of the retort is to be fragmented, i.e. there are no intact, i.e., unfragmented regions left in the retort, e.g., for support pillars or the like, the percentages would be less.

The above percentage values also apply when the relationship between the size of the columnar void and the formation that is to be expanded is expressed in terms of volume, i.e., the volume of the columnar void is from about 10% to about 20%, and preferably about 15%, of the combined volume of the columnar void and of the space occupied prior to expansion by that portion of the formation that is to be expanded to fill both the columnar void and such space.

The percentages in terms of volume as stated above, do not change when unfragmented regions are planned to be left in the retort, as in the case of support pillars, or when multiple columnar voids are employed.

The method of this invention for fragmenting oil shale is useful for forming a retort of any desired dimension. When forming a retort of a relatively small cross-sectional area, a single columnar void can be excavated through the oil shale deposit in which the retort is being formed and the oil shale surrounding the columnar void expanded toward the columnar void to form the retort. In the formation of a retort having a relatively large cross-sectional area, several columnar voids can be used; the longitudinal axes or planes of the columnar voids are generally parallel. The sum of the horizontal cross-sectional areas of the columnar voids meets the requirments described above in connection with the horizontal cross-sectional area of a single columnar void. The columnar voids can be spaced through the retort being formed so that all the oil shale within the retort is fragmented and expanded toward the columnar voids. In retorts having a relatively large cross-sectional area a portion of the oil shale can be left unfragmented in the form of vertical pillars to serve as support for the overburden, if necessary. The amount of oil shale left unfragmented in the form of pillars is taken into consideration when determining the volume of the columnar voids.

Many oil shale deposits have bedding plane dips of less than about 5°, in which case the columnar voids would be oriented so the free face extends substantially vertically and the resulting retort has substantially vertical side boundaries. If the dip of the oil shale deposit is more than about 5°, the columnar void can be oriented so that the free face and the blasting holes extend substantially perpendicular to the plane of the deposit. The result would be a retort that is reoriented accordingly to conform to the bedding plane so that the side boundaries of the retort are perpendicular to the bedding plane. This provides oil shale having approximately the same oil content across the retorting zone at any particular time as it advances through the retort.

The recovery of shale oil and product gas from the oil shale in the retort generally involves the movement of a retorting zone through the retort. The retorting zone can be established on the advancing side of a combustion zone in the retort or it can be established by passing heated gas through the retort. It is generally preferred to advance the retorting zone from the top to the bottom of a vertically oriented retort, i.e., a retort having vertical side boundaries such that the shale oil and product gases produced in the retorting zone will move by the force of gravity and with the aid of gases (air or heated gases) introduced at the upper boundary and moved to the lower boundary of the retort for collection.

A combustion zone can be established at or near the upper boundary of a retort by any of a number of methods. Reference is made to application Ser. No. 536,371, filed Dec. 26, 1974, by Chang Yul Cha, and assigned to the assignee of the present application, for one method in which an access conduit is provided to the upper boundary of the retort, a combustible gaseous mixture is introduced therethrough, and ignited in the retort. Flue gases are withdrawn through an access means extending to the lower boundary of the retort, thereby bringing about a movement of gases from top to bottom of the retort through the fragmented oil shale. A combustible gaseous mixture of a fuel, such as propane, butane, natural gas, or retort off gas, and air is introduced through the access conduit to the upper boundary and is ignited to initiate a combustion zone at or near the upper boundary of the retort. Combustible gaseous mixtures of oxygen and other fuels are also suitable. The supply of the combustible gaseous mixture to the combustion zone is maintained for a period sufficient for the oil shale at the upper boundary of the retort to become heated usually to a temperature of greater than about 900° F., (although retorting begins at about 600° F.) so that combustion can be maintained by the introduction of air (without fuel gas) into the combustion zone. Such a period can be from about one day to about a week in duration.

The combustion zone is maintained and advanced through the retort toward the lower boundary by introducing an oxygen-containing inlet gas through access conduits to the upper boundary of the retort and withdrawing flue gases from below the retorting zone. The inlet gas is generally a mixture of air and a diluent such as retort off gas or water vapor having an oxygen content of about 10% to 20% of the volume of the inlet gas. The inlet gas is moved through the retort at a rate of about 0.5 to 2 standard cubic feet of gas per minute per square foot of cross-sectional area of the retort.

The introduction of an inlet gas at the top and the withdrawal of flue gases from the retort at a lower level serves to carry the hot combustion product gases and non-oxidized inlet gases (such as nitrogen, for example) from the combustion zone and through the retort and establishes a retorting zone on the advancing side of the combustion zone. In the retorting zone, kerogen in the oil shale is converted to liquid and gaseous products. The liquid products move by the force of gravity to the lower boundary of the retort where they are collected and withdrawn, and the gaseous products mix with the gases moving through the in situ retort and are removed as retort off gas from a level below the retorting zone. The retort off gas is the gas removed from such lower level of the retort and includes inlet gas, flue gas generated in the combustion zone, and product gas generated in the retorting zone.

II. Formation of Retort by Multi-Directional Expansion

Figure 1:
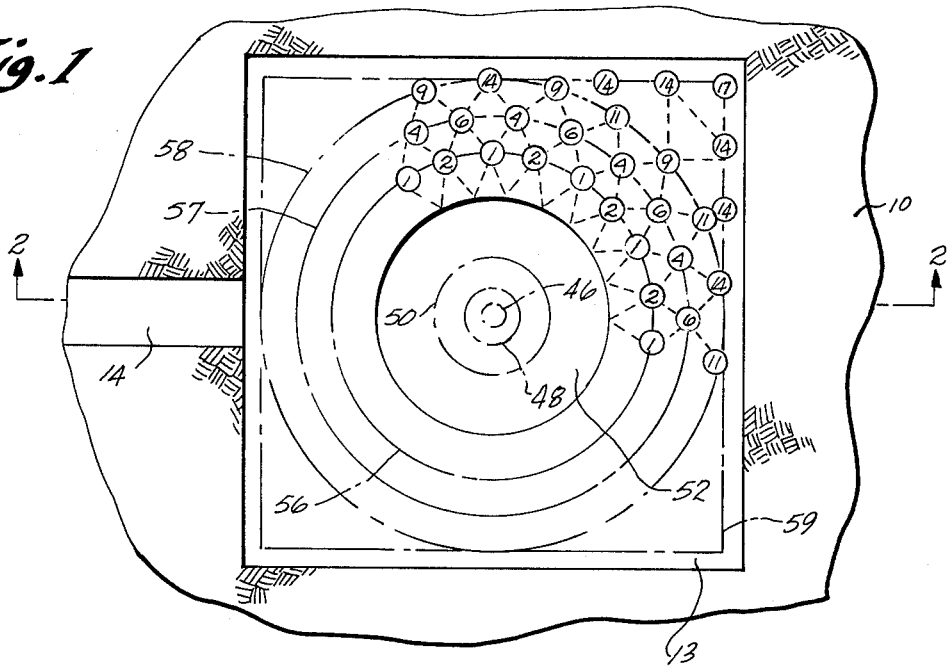
FIGS. 1 through 3 depict a portion of a subterranean formation containing an oil shale deposit during enlargement of an initial cylindrical columnar void to a final columnar void in lateral increments and the preparation of the shale adjacent to the final columnar void for multi-directional inward expansion
Figure 2:
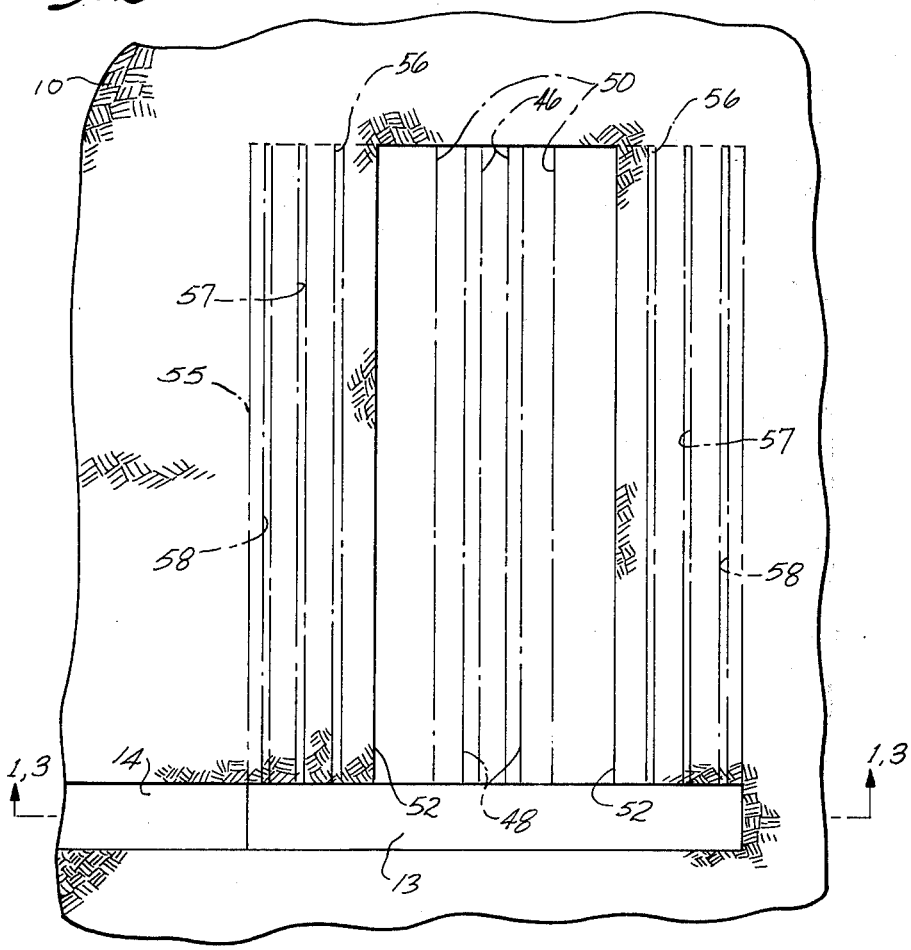
Figure 5:
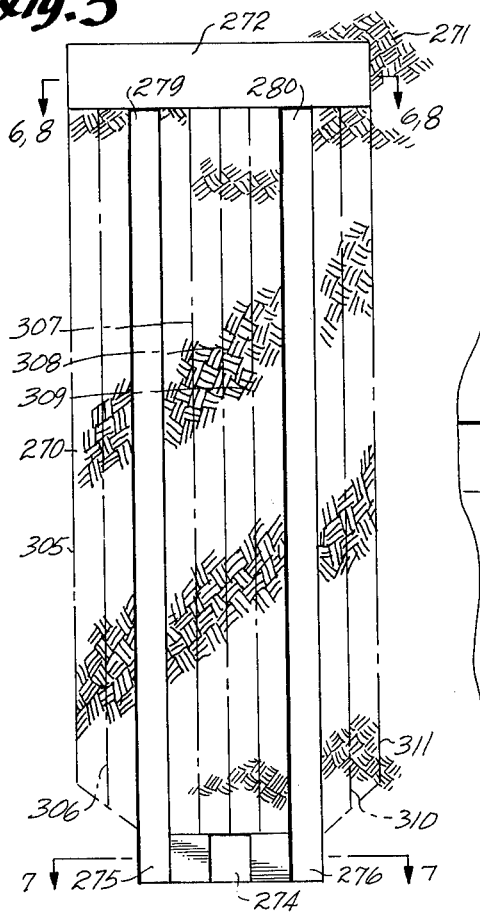
FIGS. 5 through 8 depict another portion of an oil shale seam during excavation of slots and preparation of the shale adjacent to the slot-shaped columnar voids for one directional expansion towards a free face
Figure 4:
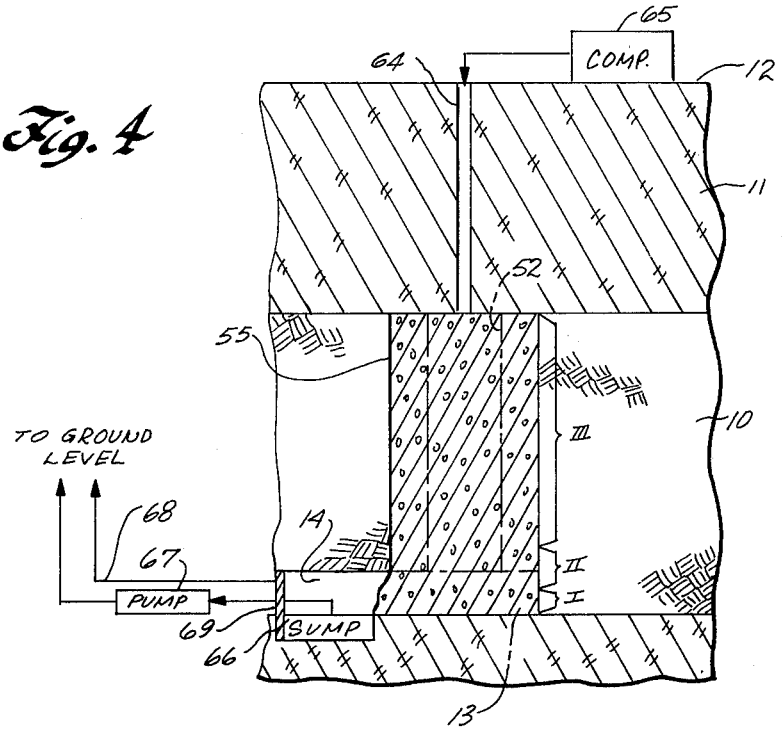
FIG. 4 is a side sectional view depicting a portion of the seam during retorting of the fragmented shale resulting from the expansion of the shale adjacent to the final columnar void in FIG. 2.

Reference is made to FIGS. 1, 2, and 4, which depict an approximately horizontal oil shale seam 10 in a subterranean oil shale deposit separated from ground level at 12 by an overburden 11. The term "seam" as used herein means the entire depth of a formation at least a part of which contains oil shale or the portion thereof under consideration. The formation containing oil shale in a vertically elongated retort 55 to be formed, represented in FIG. 2 by phantom lines, is to be fragmented for the purpose of recovering shale oil therefrom by an in situ retorting operation. Retort 55 can extend vertically from top to bottom of seam 10, can extend vertically through only part of the thickness of seam 10, or can extend vertically beyond the top and/or bottom of seam 10. In application Ser. No. 505,457, retort 55 is called a recovery zone. To prepare seam 10 for in situ recovery of shale oil, a horizontal room 13 is first excavated therein. Room 13, which in one embodiment has a square floor plan, extends along a level near the lower boundary of retort 55. A tunnel 14 and a shaft or drift, not shown, connect room 13 to ground level. The term "tunnel" is used herein to mean a horizontally extending subterranean passage, whether it be a tunnel, a drift, or an adit. Room 13 and tunnel 14 are formed by conventional mining techniques. The pillars, if any are necessary to support the roof of room 13, are formed from shale left in place during mining. The height of room 13, which is substantially smaller than any of the dimensions of its floor plan, is dictated by the space required to form the retort in the manner described below. A height of from about 12 feet to about 30 feet is found adequate in some embodiments. Tunnel 14 is preferably self-supporting, i.e., narrow enough that its roof does not subside in the absence of support pillars.

A. Excavation of Cylindrical Columnar Void

Next, a portion of the shale contained within the boundaries of the retort under formation 55 is excavated to form a columnar void from the ceiling of room 13 at the intersection of the diagonals of the floor plan to the upper boundary of retort 55. Although the columnar void is preferably cylindrical when multi-directional inward expansion of the shale is employed so that the shale can be expanded symmetrically about the free face of the columnar void, the columnar void can also be non-cylindrical in cross section, e.g., oval or square, etc. The columnar void can be regarded as a raise or winze, and in face is called a raise in application Ser. No. 505,457, but this terminology is not used herein, because the terms raise and winze sometimes connote a passage that performs the function of communicating between the levels in a subterranean mine, which is not the function of the columnar void herein or in application Ser. No. 505,457. Furthermore, the columnar void herein generally has a larger diameter than raises and winzes used in many mining operations.

1. Vertical Increments

The columnar void can be formed in any number of ways, one of which is to blast it out in its full cross section in a series of increments moving from the room toward the upper boundary of the retort. Typical patterns for the placement of blasting holes used for incrementally developing an open space are shown in *Blasters' Handbook,* 15th Edition, published by E. I. duPont de Nemours & Company, Wilmington, Delaware.

2. Lateral Increments

Another method of forming the columnar void is to blast it out in its full length in a series of annular increments moving from the center outwardly. An initial vertically oriented hole or cylindrical columnar void of small diameter is drilled from the middle of room 13 upwardly to the top of the retort. As used herein, the term "cylindrical" refers to a right-circular cylinder. This initial columnar void is enlarged by drilling vertically oriented blasting holes in a ring pattern around and substantially parallel to the initial columnar void over its entire length. An explosive is placed in the blasting holes and is detonated to expand shale into the columnar void. The shale falls as debris into room 13, from which it is removed. This is repeated to enlarge the columnar void to the desired diameter.

Figure 3:
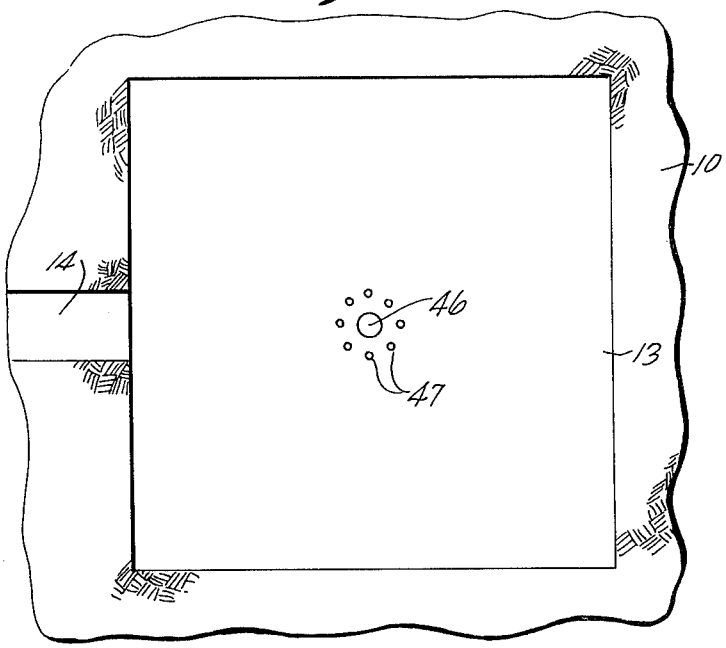
Figure 6:
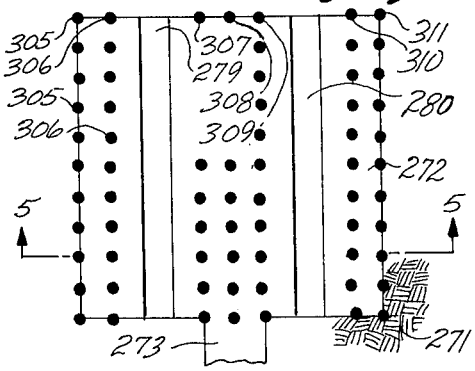
Figure 7:
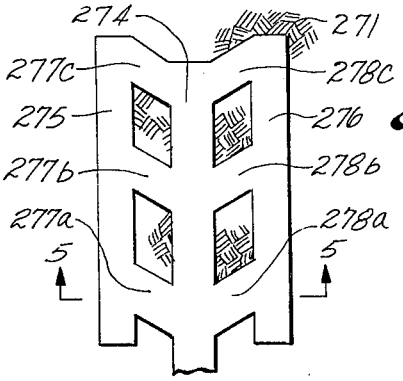

Reference is made to FIG. 3 for a description of one method of enlargement of the columnar void. The initial columnar void is designated 46. The cylindrical surface of initial columnar void 46 constitutes a free face from which the diameter of the columnar void may be enlarged in lateral annular increments.

A plurality of vertically extending blasting holes 47 are drilled upwardly from room 13 in a coaxial ring around and substantially parallel to columnar void 46. The enlargement of columnar void 46 involves the shale in the region between the free face established by the surface of columnar void 46 and the ring of blasting holes 47, which defines the boundary of the region to be fragmented between the ring of blasting holes and columnar void 46. Blasting holes 47 are spaced from the free face at columnar void 46 so that the shale in the region defined by the columnar void and the ring of blasting holes will expand toward the free face of the columnar void. The expanded shale should have sufficient void volume distributed therethrough that the expanded shale remains free to move down through the new columnar void created by detonating the explosive in blasting holes 47 into room 13. Sufficient void volume is generally provided when the cross-sectional area of the columnar void is about 18% or more, and preferably about 25% or more, of the cross-sectional area of the region defined by the ring of blasting holes 47. Thus, a void volume in the expanded shale of from about 18% to about 25% is found to be satisfactory for the formation of a columnar void.

The number and size of the blasting holes 47 are sufficient for an explosive of a given energy content to fragment all the shale within the region between columnar void 46 and blasting holes 47. The amount of explosive and the placement of the explosive is determined for each oil shale deposit with the size and spacing of the blasting holes being selected to accommodate the quantity of explosive required to move and fragment the burden between the holes and the columnar void.

In this embodiment, columnar void 46 is about two feet in diameter and the ring of blasting holes 47 is about 4 feet in diameter to provide about 25% void volume within the area defined by the ring of blasting holes 47. Ring of blasting holes 47 comprises eight equally spaced blasting holes having a diameter of about 3 inches.

Blasting holes 47 are loaded with an explosive charge, e.g., ammonium nitrate mixed with fuel oil (ANFO), or dynamite. The charge is detonated and the resulting explosion fragments the shale within the ring of blasting holes and the fragmented shale falls to room 13, thereby forming a new columnar void 48 (FIG. 1) with a free face along the former ring of blasting holes 47. The fragmented shale is removed from room 13 through tunnel 14 to ground level or elsewhere in the underground facility.

The process is repeated to enlarge columnar void 48 to columnar void 50 (FIG. 1) and then to final columnar void 52 having the desired diameter, i.e., in this embodiment about 16 feet. The surface of the formation defining columnar void 52 provides a cylindrical free face extending vertically through retort 55.

B. Blasting to Columnar Void

Columnar void 52 has a vertical axis extending through the center of retort 55. The volume of retort 55 is defined approximately by the area of the floor plan of room 13 and the height of columnar void 52. In other words, the horizontal cross section of retort 55 coincides approximately with the floor plan of room 13 and the vertical length of retort 55 approximately equals the height of columnar void 52 and room 13. As shown, the horizontal cross section of columnar void 52 is preferably circular and the horizontal cross section of retort 55 is preferably square, so that the quantity of shale inwardly expanded in all directions normal to the free face in columnar void 52 is as nearly as possible the same, while minimizing the amount of intact shale left between adjacent retorts. However, the horizontal cross section of retort 55 could have a non-square rectangular shape, in which case the quantity of shale inwardly expanded in all directions about columnar void 52 would not be as nearly the same, or the horizontal cross section of retort 55 could have a circular shape, in which case more intact shale would be left between adjacent retorts.

The horizontal cross section of retort 55 and the floor plan of room 13 are still regarded as square, although their sides may deviate slightly from orthogonality to achieve alignment with vertical cleavage planes in the manner taught in an application of Richard D. Ridley, entitled "In Situ Recovery of Oil Shale," Ser. No. 563,607, filed Mar. 31, 1975 and assigned to the same assignee as this application.

All the shale extending away from the cylindrical free face between columnar void 52 and the side boundaries of retort 55 is explosively expanded toward the columnar void in a plurality of concentric annular layers of oil shale progressing outwardly away from the cylindrical free face in rapid sequence. The expansion is in a direction normal to the cylindrical free face of columnar void 52 and, within a ring of blast holes, is thus multidirectional. In other words, each layer completely surrounds the free face of columnar void 52. Each layer is completely severed from the adjoining shale to form a new cylindrical free face on the unfragmented oil shale prior to the severance of the next layer; but the sequence is sufficiently rapid so that all the layers move toward the longitudinal axis of columnar void 52, i.e., in a horizontal direction, to fill the space before the shale in any layer drops appreciably due to gravity.

The void fraction of the resulting fragmented shale depends upon the ratio of the horizontal cross-sectional area of columnar void 52 to the horizontal cross-sectional area of retort 55, which is approximately the same as the area of the floor plan of room 13. If different local void fractions are desired at different levels of retort 55, the horizontal cross-sectional area of columnar void 52 and/or retort 55 would vary accordingly. As discussed below, it is also noted that at the bottom of retort 55, the local void fraction of the fragmented shale is increased by room 13, but the increase does not extend more than about twice the height of room 13. Thus, to control the void fraction in the retort remote from room 13, one selects the diameter for columnar void 52.

In this embodiment, the horizontal cross section of retort 55 is about 35 feet by about 35 feet, the diameter of columnar void 52 is about 16 feet, and the vertical height of retort is about 80 feet.

To prepare the region around columnar void 52 for explosive expansion, concentric rings 56, 57, and 58 of vertical blasting holes are drilled upwardly from room 13 along the entire length of columnar void 52. Rings 56, 57, and 58 are coaxial with columnar void 52. A closed square border 59 of vertical blasting holes covers the corners of the region to be fragmented. Border 59 defines the horizontal cross-sectional area of retort 55. In practice, it is not possible to drill border holes 59 precisely along the edges of room 13, so the horizontal cross-sectional dimensions of retort 55, i.e., 35 feet by 35 feet, will be slightly smaller than the dimensions of room 13, i.e., 38 feet by 38 feet. Blasting holes 56 through 59 are thus parallel to the free face of columnar void 52. About one-quarter of the blasting holes are represented in FIG. 1.

If a non-cylindrical columnar void is employed the arrangement of blasting holes would vary to provide in each case expansion of layers of shale of as nearly as possible uniform thickness toward the columnar void. In other words, if the horizontal cross section of the columnar void is oval or square, the blasting holes would also be arranged in oval or square groups around the columnar void, instead of groups of blasting holes arranged as rings, as shown.

It has been found that the shale will fracture without fragmenting if the distance from the blasting holes to the free surface toward which the shale is expanding, hereafter called the blasting distance, exceeds a certain limiting value. In the case of ring of blasting holes 56, the blasting distance extends from ring of blasting holes 56 to the free face of columnar void 52; in the case of ring 57, the blasting distance extends from ring 57 to the free face created at ring 56; and in the case of ring 58, the blasting distance extends from ring 58 to the free face created at ring 57. To a certain extent, the limit on the blasting distance depends upon the diameter of the blasting holes, the energy of the explosive utilized, and the density of the burden. For example, if the explosive is ANFO, the burden is shale in the Piceance Basin, and the diameter of the blasting holes is 3 inches, the limit is approximately 10 feet; if the diameter of the blasting holes is 6 inches, the limit is approximately 15 feet.

In one embodiment the blasting holes are distributed so that the length of the sides of the imaginary triangles formed between adjacent holes in each ring and in intermediate point on the free face toward which the ring is expanding, i.e., an adjacent inner ring, represented in FIG. 1 by dashed lines, do not exceed the limit on the blasting distance. In another embodiment described in connection with FIGS. 9 and 10, the distance between blasting holes and between a blasting hole and a free face, does not exceed the blasting distance. The number of rings and the number of blasting holes in each ring can vary depending upon the cross-sectional area of retort 55, the diameter of the blasting holes, the energy of the explosive utilized and the density of the burden. Additional blasting holes, not shown, can be located in the region between ring 58 and the corners of border 59. Also, more or fewer rings of blasting holes than shown can be empoloyed depending upon the desired particle size, the horizontal cross-sectional area of the retort, and the type of explosive used. The determination of the number of blasting holes, their diameter and spacing, both for columnar void and for retort formation, in view of the teaching herein, is within the skill of the art.

The entire length of the blasting holes is loaded from room 13 with an explosive, such as dynamite or ANFO. In the case of ANFO, about 0.5 to 1.5 net tons of shale can be fragmented per pound of explosive. The explosive in the blasing holes is detonated in a single round, i.e., in an uninterrupted sequence, in the following order in FIG. 1:

a. ring or group of blasting holes 56
b. ring or group of blasting holes 57
c. ring or group of blasting holes 58
d. border group of holes 59, with the exception of the corner holes
e. the corner holes of border group of holes 59.

On the one hand, the time delay between each of the above steps is sufficiently large to permit the layer of shale created by detonating the explosive in each ring to be fragmented and to completely break away from the remaining shale surrounding it, thereby creating a new free face prior to the detonation of the explosive in the next ring of blastin holes. This insures that the shale does not fracture without fragmenting. On the other hand, the time delay between each of the above steps is short enough so that the layers of fragmented shale do not fall appreciably due to gravity before the blasting sequence is completed. This promotes a more uniform distribution of the void volume and permeability along the height of retort 55. In summary, the delay between the steps of the sequence is such that the shale surrounding columnar void 52 expands inwardly in discrete fragmented layers of oil shale to fill the available space before expanding appreciably in a downward direction.

Within each ring or group of blasting holes there is a small delay between detonation of the explosive in alternate holes to cause the shale to break up vertically in the vicinity of the holes. This provides better fragmentation. The detonators for the blasting holes are provided with delay fuses that are triggered simultaneously. The numbers of these delay fuses are indicated in FIG. 1 inside the circles representing the respective blasting holes. As measured from the instant of triggering the fuses, the following correspondence between fuse numbers and time delays exists:

| Fuse Number | Time Delay |
|---|---|
| No. 1 | 25 milliseconds |
| No. 2 | 50 milliseconds |
| No. 4 | 100 milliseconds |
| No. 6 | 170 milliseconds |
| No. 9 | 280 milliseconds |
| No. 11 | 320 milliseconds |
| No. 14 | 500 milliseconds |
| No. 17 | 700 milliseconds |

Thus, the oil shale adjacent to columnar void 52 is explosively expanded toward its free face in a single round. There are a plurality of explosions in the blasting holes of each ring. The explosions progress outwardly from the free face in sequential series so that a plurality of layers of oil shale parallel to the free face are expanded sequentially progressing away from the free face. The layers are severed along the rings of blasting holes. For the time delays enumerated above, spanning a time period of slightly less than 700 milliseconds, some of the shale near the work room could drop less than eight feet due to the force of gravity during the blasting sequence, which is not appreciable in a retort 80 feet or more high.

Prior to detonation of the charge in rings 56, 57, and 58, and border 59, a portion of the rubble removed in the course of the formation of room 13 is returned to room 13 to increase the quantity of shale in the retort. In the embodiment given above, where the height of room 13 is about 12 feet, the returned rubble can be placed in room 13 to a level of about 6 feet, leaving room 13 with a space about 6 feet high prior to explosive expansion of the oil shale surrounding the columnar void. The room can also be completely filled or left empty.

In the above discussion it has been assumed that the bedding plane of seam 10 is approximately horizontal. If the bedding plane dips appreciably, i,e., more than about 5° from the horizontal, room 13 and columnar void 52 can be oriented to enable the fragmented retort to extend perpendicularly from the bedding plane; in other words, the floor of room 13 slopes at the same angle as the bedding plane and columnar void 52 extends from room 13 at an angle normal to the slope of the bedding plane.

C. Retorting

Reference is made to FIG. 4, which depicts seam 10 after fragmentation of the shale contained in retort 55, which has top, bottom, and side boundaries of unfragmented shale. The void fraction will generally vary from top to bottom of retort 55, i.e., between horizontal segments of the retort. A region I at the bottom of retort 55, which corresponds to the rubble returned to room 13 prior to explosive expansion, has a void fraction (volume of void/total volume of region) of approximately 0.40 or 40%. In a narrow region II (not drawn to scale) which extends above region I to a height several times the height of the space in the room above the rubble that has been returned to room 13, the shale adjacent to columnar void 52 expands downwardly as well as inwardly and has a void fraction of approximately 30%. In a region III, which extends between region II and the top of retort 55, i.e., the major portion of the height of retort 55, the shale adjacent to columnar void 52 expands inwardly and has a void fraction governed by the ratio of the horizontal cross-sectional area of columnar void 52 to that of retort 55, i.e., in this embodiment approximately 0.18 to 18%. This ratio is sufficiently small so the expanded shale adjacent to columnar void 52 fills columnar void 52 and the space occupied by the expanded shale and is sufficiently large so the expanded shale is capable of completely fragmenting. The overall void fraction within retort 55 in this embodiment is approximately 20%. Regions I, II, and III together comprise one continuous mass of fragmented oil shale. The former locations of room 13 and columnar void 52 are shown by phantom lines.

Room 13 is used to prepare the shale surrounding columnar void 52 for inward expansion in successive layers of oil shale, in other words, to provide the access needed to drill blasting holes around columnar void 52, and to load such blasting holes with explosive charge. The higher void volume in regions I and II results inherently from room 13, and reduces somewhat the total quantity of shale oil obtained from these regions because less shale is present for retorting. For this reason, the floor plan of room 13 can be somewhat smaller than the horizontal cross-sectional areas of retort 55, and the blasting holes can be drilled upwardly into the ceiling of the room so that they diverge at a small angle from the attitude of columnar void 52, and the other blasting holes can be drilled outwardly from the side walls of room 13 in a direction perpendicular to the attitude of columnar void 52; this tends to reduce the size of regions I and II relative to region III and thus increase the amount of shale that is retorted in the in situ retort. (In this case, the floor plan of the room is still regarded as "coinciding approximately with the cross section of the retort" and the lengths of the majority of blasting holes, although not parallel to the length of the columnar void, are still regarded as "extending along the length of the columnar void," as these terms are used in the claims.) In embodiments in which the shale surrounding columnar void 52 is inwardly expanded in successive layers after prepartion from a room or work area located above or below the upper and lower boundaries of the retort being formed, room 13 is eliminated altogether to increase the amount of shale that is retorted in a given retort volume. This embodiment is advantageous in cases wherein the work room can be located in a portion of the subterranean formation which is devoid of or low in kerogen content, as in the case of relatively shallow oil shale deposits of say up to 200 feet thick.

A gas inlet to the top of the retort represented for simplicity as a single conduit 64, connects a compressor 65 located at ground level 12 to one or more points distributed about the top of retort 55. Because of the permeability of the fragmented shale, compressor 65 is visually required to deliver air or other retorting gas at about 5 psi or less.

The fragmented shale at the top of the retort is ignited to establish a combustion zone, compressor 65 supplies air or other oxygen supplying gas for maintaining combustion in the combustion zone and for advancing the combustion zone slowly downward through the retort with a horizontal advancing front. Carbonaceous values comprising liquid shale oil and gases are released from the fragmented shale by the heat from the combustion zone in a retorting zone which is ahead of the advancing front of the combustion zone. Heat from the combustion zone is carried to the retorting zone on the advancing side of the combustion zone by combustion product gases and heated unburned inlet gases, such as nitrogen of the inlet air, which are caused to flow downwardly by the continued introduction of gases through the inlet to the top of the retort, and the withdrawal of gases from the bottom of the retort. The flowing hot gases heat the oil shale in the retorting zone a few feet thick. Kerogen in the oil shale is decomposed in the retorting zone releasing shale oil and some hydrocarbon gases. The unfragmented shale bordering the retort 55 is also partially retorted. The shale oil percolates downward to the bottom of the retort 55 in advance of the combustion zone, and the retort off gas is passed to the bottom of the retort 55 by the movement of gas introduced at the top of the retort 55, passed through the retort 55, and withdrawn at the bottom. Shale oil collects in a storage area in the form of a sump 66 which is located at the low point of an access to the bottom of the retort. Depending upon the slope of room 13, special grading and/or drainage ditches can be provided in the retort floor prior to the explosive expansion in order to provide drainage for the shale oil to sump 66. A pump 67 carries the shale oil from sump 66 to ground level. A conduit 68 carries the off gas recovered from the retorting process from a sealed bulkhead 69 in tunnel 14 to ground level.

Alternatively, an oxygen free retorting gas at a temperature sufficient to heat the fragmented oil shale in the retort to a retorting temperature is introduced into the top of the retort, bringing about the retorting of the oil shale in a retorting zone, and withdrawing the shale oil and gaseous retorting products from the in situ report.

III. Formation of Retort by One-Directional Expansion Toward a Free Face

Reference is made to FIGS. 5 through 8, which depict a retort 270 to be formed in a horizontal oil shale seam 271 in a subterranean oil shale formation. Briefly, a slot-shaped columnar void extends across the entire width of the retort and the layers of expanded shale do not completely surround the columnar void, but are instead parallel to the two planar free faces extending across the width of the entire retort in the columnar void. Thus, the expansion toward each of the two planar free faces is one-directional, and the expanded shale does not tend to wedge during expansion to the extent it does during inward multidirectional expansion toward a cylindrical free face. Consequently less explosive is required to fragment a given amount of oil shale and/or the same quantity of explosive will fragment a given amount of oil shale more thoroughly. Also, more even distribution of the void volume throughout the retort results.

To prepare seam 271 for in situ recovery of shale oil, a horizontal room 272 is first excavated near the top thereof. Room 272, which has a square floor plan in this embodiment coniciding approximately with the horizontal cross section of retort 270, extends along a level near the upper boundary of retort 270. A tunnel 273 and a shaft or drift (not shown) connect room 272 to ground level. Parallel tunnels 274, 275, and 276 lie under room 272 near the lower boundary of retort 270. Tunnel 274, which lies under tunnel 273, is connected to ground level by a shaft or drift (not shown). Tunnel 275 is connected to tunnel 274 by oblique tunnels 277*a*, 277*b*, and 277*c*. Tunnel 276 is connected to tunnel 274 by oblique tunnels 278*a*, 278*b*, and 278*c*.

A. Excavation of Slot-Shaped Columnar Voids

After room 272 and tunnels 273 through 278 are excavated, slot-shaped columnar voids 279 and 280, hereafter designated "slots," are excavated. Slots 279 and 280 extend verticallly downward from the bottom of the room 272 to the top of tunnels 275 and 276, respectively, and extend horizontally completely across room 272. The horizontal cross section of slots 279 and 280 coincides with the floor plan of the portions of tunnesl 275 and 276, respectively, which are within the lateral boundaries of the retort which is being formed.

Figure 8:
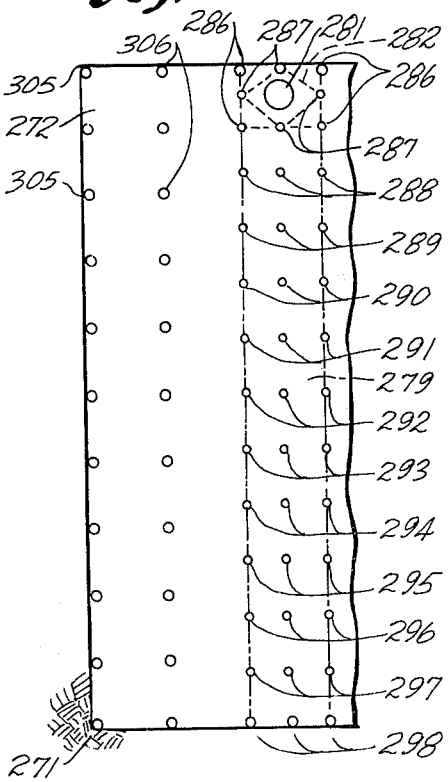

FIG. 8 represents room 272 prior to formation of slot 279, which is designated by phantom lines. To excavate slot 279, a small columnar void 281 is first bored down from the floor of room 272 to tunnel 275 near one end of slot 279. Blasting holes 286 are drilled down from the corners of a square region in the floor of room 272 surrounding columnar void 281 to tunnel 275. Blasting holes 287 are drilled down from the floor of room 272 between blasting holes 286 to tunnel 275. Blasting holes 287 are loaded with an explosive, such as ANFO, which is detonated. The resulting debris falls into tunnel 275 from which it is removed via tunnel 277*c* and tunnel 274, leaving a vertically elongated columnar void having a diamond-shaped cross section indicated at 282. Thereafter, blasting holes 286 are loaded with an explosive, which is detonated. The resulting debris falls into tunnel 275 from which it is removed via tunnel 277*c* and tunnel 274, leaving a vertically elongated columnar void having a square horizontal cross section. Next, blasting holes 288 are drilled down from the floor of room 272 to tunnel 275, and loaded with an explosive, which is then detonated to enlarge the vertically elongated columnar void. Next, blasting holes 289 are drilled down from the floor of room 272 to tunnel 275, loaded with an explosive charge, and detonated to further enlarge the vertically elongated columnar void. Similarly, blasting holes 290, 291, 292, 293, 294, 295, 296, 297, and 298 are in turn drilled, loaded, and detonated to expand the vertically elongated columnar void completely across room 272, thereby forming slot 279. After each detonation, the debris falling into tunnel 275 is removed therefrom via tunnels 277*a*, 277*b*, and 277*c*, and tunnel 274. Alternatively, all of blasting holes 286 through 298 could be drilled prior to loading with explosive and detonation. As illustrated in FIG. 8, blasting holes 286 through 298 are arranged in three rows extending across room 272; two of the rows are aligned with the sides of slot 279, and the third row lies midway between the first two rows. Slot 280 is excavated in the same manner as slot 279, either simultaneously therewith or thereafter. Other arrangements of blasting holes for the excavation of a slot will be apparent to those skilled in the art.

B. Blasting to Slots

The large vertical surfaces of each of slots 279 and 280 provide two planar free faces extending vertically through retort 270 substantially over its entire width (or length) and a greater part of its height. The formation extending from each free face is expanded in a direction normal thereto, i.e., onedirectional. All of the shale extending from a free face that is to be expanded toward a free face in a columnar void, i.e., the shale between one free face in slot 279 and one side boundary of retort 270 and the shale between the other free face in slot 279 and the row of blasting holes 308, on the one hand, and the formation containing oil shale between one free face in slot 280 and another side boundary of retort 270 and the shale between the other free face in slot (columnar void) 280 and the row of blasting holes 308, on the other hand, is explosively expanded in a plurality of parallel planar layers in a rapid sequence progressing away from the planar free faces. In this manner, the portion of the formation, which is to be fragmented by expansion towards a columnar void, and which is within the boundaries of the retort and extends away from such a free face, is explosively expanded toward such a columnar void. The free faces are still regarded as vertical although they may deviate slightly from verticality to achieve alignment with a vertidal cleavage plane, in the manner taught in application Ser. No. 536,607. The volume of retort 270 is defined approximately by the area of the floor plan of room 272 and the height of slots 279 and 280 plus room 272. In other words, the horizontal cross section of retort 270 coincides approximately with the floor plan of room 272 and the vertical height or retort 270 approximately equals the height of slots 279 and 280 plus the height of room 272. Since the expansion of shale is one-directional with respect to each face in this embodiment, as distinguished from the embodiment in which the shale is expanded multi-directionally to a cylindrical columnar void, this embodiment is suitable for forming an in situ retort having a horizontal cross-sectional area with a non-square rectangular shape. The void fraction of the fragmented shale formed within retort 270 along a major portion of the height of the columnar void is determined by the ratio of the sum of the horizontal cross-sectional areas of slots 279 and 280 to the horizontal cross-sectional area of the retort 270 at such section. The overall void fraction in the fragmented shale in the retort can be expressed as the ratio of the sums of the volumes of the columnar void and of the work room to the volume of the retort that is filled with fragmented shale.

Parallel rows of blasting holes 305, 306, 307, 308, 309, 310, 311 are drilled down from the floor of room 272 to the bottom of retort 270. Row 305 is arranged along one side of room 272. Row 306 lies midway between row 305 and one free face of slot 279. Row 308 lies midway between the other free face of slot 279 and one free face of slot 280. Row 307 lies midway between the other free face of slot 279 and row 308, and row 309 lies midway between the one free face of slot 280 and row 308. Row 311 is arranged along the other side of room 272, and row 310 lies midway between row 311 and the other free face of slot 280. Rows of blasting holes 306 and 310 are incrementally shorter than the height of slots 279 and 280, and rows of blasting holes 305 and 311 are incrementally shorter than the height of rows of blasting holes 306 and 310 so as to provide a slope for the botttom of retort 270; thus, although these blasting holes do not extend the entire height of slots 279 and 280, they do extend a principle portion of the entire height. In other words, each blasting hole terminates at a point, on a vertial section passing through the blasting hole, in the retort being formed such that the ends of the blasting holes are located on a surface of the non-planar end boundary that is formed upon the detonation of explosive in the holes. Rows of blasting holes 305 through 311 are all loaded with an explosive, such as ANFO, which is detonated in a single round progressing sequentially outwardly from the free faces of slots 279 and 280. Rows of blasting holes 307, 308, 309 extend to the level of the floor of tunnels 274 through 277, except for those blasting holes that lie directly above tunnels 274 and 277. Thus, the intact shale pillars between tunnels 274 through 277 (FIG. 7) are fragmented when the explosive in rows of blasting holes 307, 308, and 309 is detonated. In one embodiment, rows of blasting holes 306, 307, 309, 310 are all provided with No. 1 and No. 2 fuses in alternate blasting holes, and rows of blasting holes 305, 308, and 311 are all provided with No. 4 and No. 6 fuses in alternate blasting holes, where the fuse numbers have the time delays given above. Instead of drilling rows of blasting holes 305 through 311 after excavation of slots 279 and 280, they can be drilled at the same time as blasting holes 286 through 298.

In one embodiment, room 272 has a square floor plan that is about 120 feet on a side, and a height of about 30 feet. Slots 279 and 280 each have a length of about 120 feet, a width of about 12 feet, and a height of about 252 feet, and the resulting void fraction along the height of slots 279 and 280 is approximately 20 percent. Tunnels 274, 275, 276, and 277*a* through 277*c* have a heigh of about 15 feet. Tunnels 275 and 276 have a length of about 120 feet and a width of about 12 feet, tunnels 274 and 277*a* through 277*c* have a width of about 15 feet. Columnar void 281 has a diameter of about 6 feet and is centered on an axis spaced about 6 feet from the side of retort 270 and about 6 feet from each free face of slot 279 which is to be formed. Blasting holes 286 through 298 each have a diameter of about 4½ inches. Blasting holes 286 and 287 are spaced about 6 feet from each other. Blasting holes 288 are spaced about 6 feet from each other and about 8 feet from the closest of the adjacent group of blasting holes 286 and 287. Blasting holes 289 and 298 are all spaced about 6 feet from each other and about 10 feet from the adjacent group of blasting holes. The blasting holes of rows 305 and 311 each have a diameter of about 6¼ inches. The blasting holes of rows 305 through 311 are all spaced about 12 feet from each other and about 12 feet from the next adjacent row of blasting holes and/or about 12 feet from the next adjacent free face of slot 279 and 280. In summary, in the formation of retort 270 of this embodiment, two 6 foot diameter raises are bored, 82 4½ inch blasting holes are drilled, and 77 6¼ inch blasting holes are drilled.

As first the explosive in rows of blasting holes 306, 307, 309, and 310 is detonated and thereafter as the explosive in rows of blasting holes 305, 308, and 311 is detonated, the shale is expanded toward slots 279 and 280 in vertical planar layers aligned with slots 279 and 280, i.e., parallel to their free faces. The layers of shale are severed in a sequence progressing away from the free faces of slots 279 and 280 and fragmented. Unless shale from above room 272 is explosively expanded into room 272 or fragmented shale is returned to fill room 272 before explosive expansion, the top of room 272 is not filled with shale after fragmentation of the shale within retort 270.

Another embodiment is identical to that described in the preceding two paragraphs except that the three rows of blasting holes between slots 279 and 280, i.e., rows 307, 308, and 309, are replaced with five rows of blasting holes. Progressing from slot 279 to slot 280, the first row is spaced about 9½ feet from slot 279, the second row is spaced about 9½ feet from the first row, the third row is spaced about 5 feet from the second row, the fourth row is spaced about 5 feet from the third row, and the fifth row is spaced about 9½ feet from the fourth row and about 9½ feet from slot 280. The blasting holes of each of the five rows are spaced about 15 feet apart. The blasting holes of the third row have a diameter of about 4½ inches, and the blasting holes of the other four rows have a diameter of about 6¼ inches. The explosive in the first and fifth rows is detonated first, followed by the explosive in the second and fourth rows, and finally by the explosive in the third row.

After fragmenting the shale continued in retort 270, which is left with top, bottom, and side boundaries of unfragmented formation, oil is recovered therefrom in the manner described above in connection with FIG. 3.

Instead of employing room 272, which has a floor plan coniciding with the horizontal cross section of retort 270, the base of operations from which the blasting holes are drilled and loaded with an explosive charge can comprise tunnels lying outside the retort in the planes of the blasting holes. The blasting holes can be drilled so as to fan out from the tunnels or extend therefrom in parallel relationship.

In one embodiment of FIGS. 5 through 8, slots 279 and 280 provide four planar free faces toward each of which the shale in retort 270 is one-directionally expanded. In general, sufficient free faces are provided to fragment all the shale in retort 270 in about two or three sequential layers, to minimize the delay between the first and last detonations. In the case of retorts of small cross-sectional area, expansion of shale toward one or both of the free faces of a single slot can be sufficient to achieve this purpose.

IV. Position of Columnar Void

The position of the columnar void or voids relative to the room depends upon the height of the resulting retort. Although the different columnar void positions relative to the room are illustrated in connection with the use of cylindrical columnar voids, the same positions also apply to slot-shaped columnar voids as described in connection with FIGS. 5 through 8.

A. Above Room

The embodiment of the invention disclosed in connection with FIGS. 1 through 3, in which the columnar void extends above the room, is used for fragmentation of short retorts, i.e., about 200 feet or less in height. It is difficult to drill and load blasting holes longer than about 200 feet upwardly from a room located at the bottom of the retort.

B. Below Room

Figure 9:
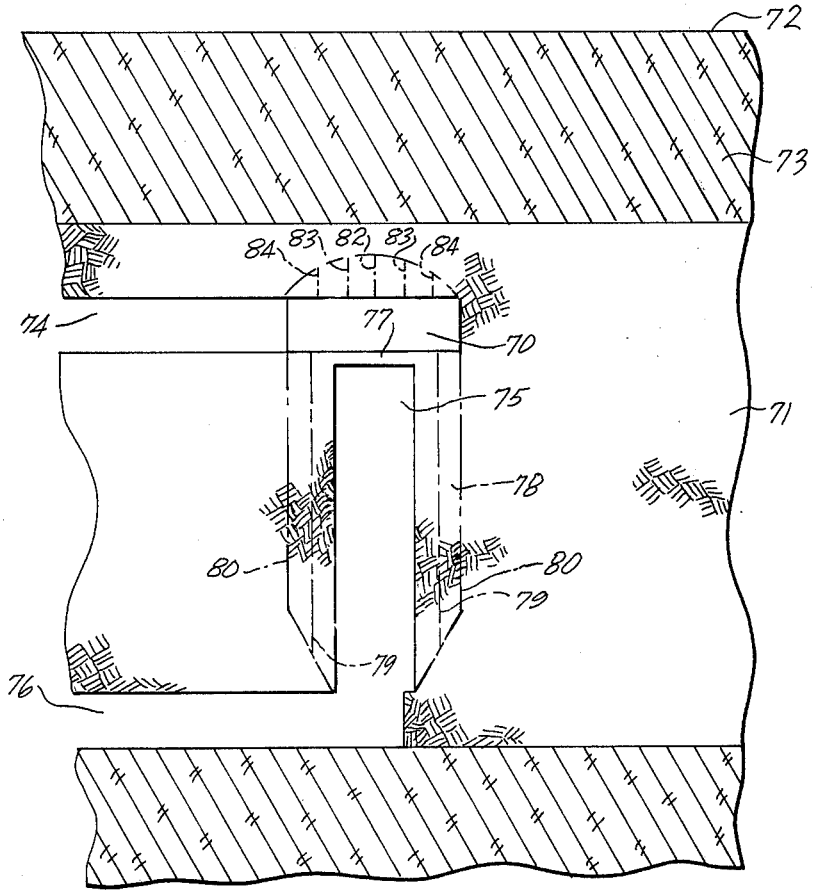
FIGS. 9 and 10, which are side sectional views through orthogonal vertical planes, depict another portion of an oil shale seam in which a room employed to prepare a retort for fragmentation is located above a columnar void.
Figure 10:
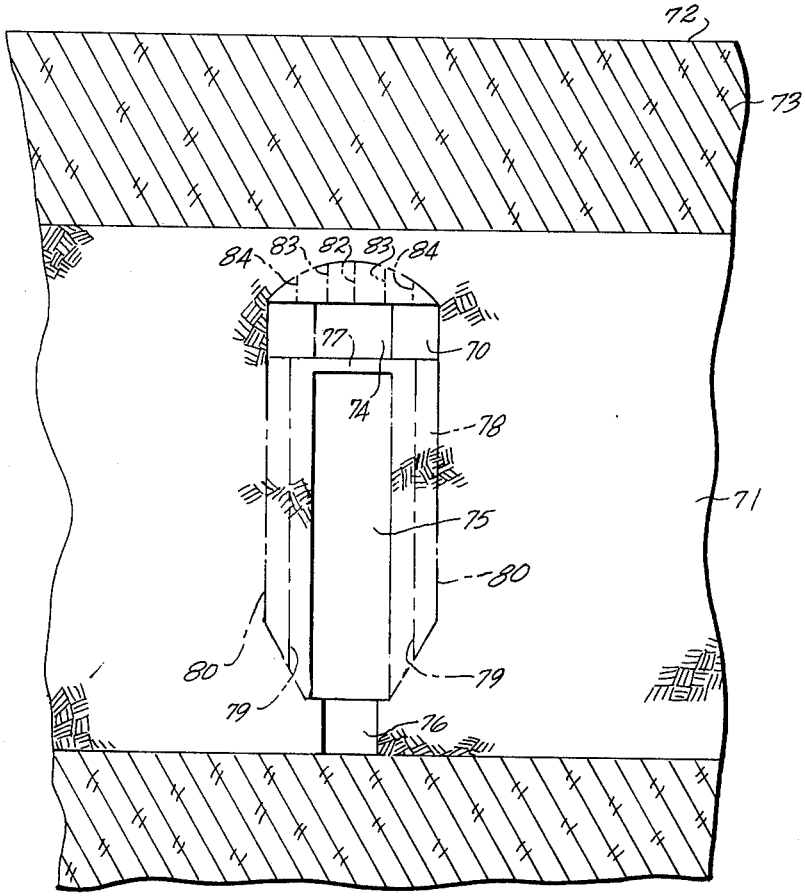
Figure 11:
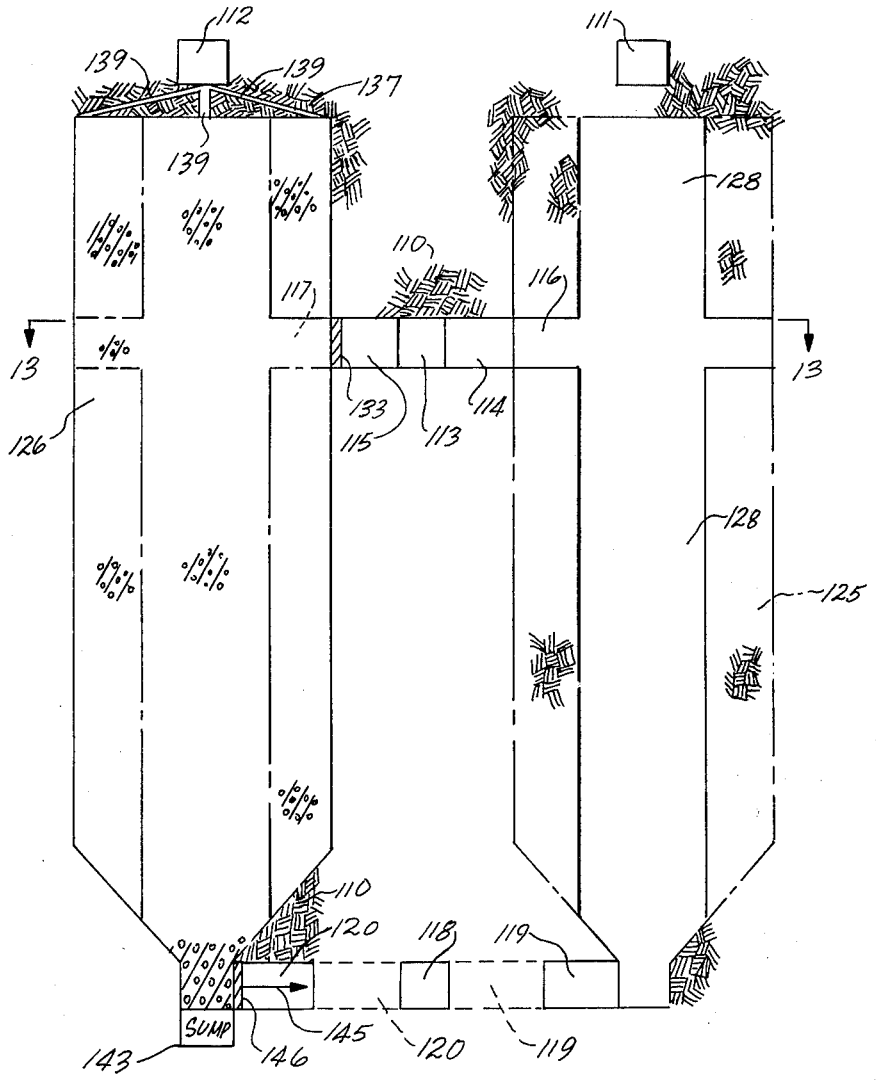

Reference is made to FIGS. 9 and 10 for another embodiment of the invention in which the columnar void extends below the room. A horizontal room 70 is excavated near the top of a retort to be formed in a subterranean oil shale seam 71, which is separated from ground level at 72 by an overburden 73. A tunnel 74 and a shaft or drift (not shown) connect room 70 to ground level. A cylindrical columnar void 75 is excavated from just below the center of the floor of room 70 to a tunnel 76, which is located below the retort. Tunnel 76 is also connected to ground level by a shaft or drift (not shown). Columnar void 74 is formed in the manner described above in connection with FIGS. 1 through 3. The top of columnar void 75 terminates short of room 70. The shale left between columnar void 75 and room 70 forms a horizontal pillar 77, which leaves the floor of room 70 free from a hazardous condition, namely, a large opening, during the operations subsequently conducted therefrom. The debris created during formation of columnar void 75 falls into tunnel 76 and is transported therefrom to ground level. Most advantageously, tunnel 76 is utilized for two functions — first, during the formation of columnar void 75, as a base of operation from which the work takes place and an egress for removal of debris, and second, during retorting, as a point of collection for hydrocarbon values and an egress for removal thereof. The sump for collecting shale oil is located in tunnel 76 after the in situ retort is formed. In this embodiment, tunnel 76 is formed before columnar void 75. Alternatively, the first function can be performed from room 70, in which case pillar 77 is eliminated and tunnel 76 can be formed after columnar void 75 is formed.

The shale in a retort 78, represented in FIGS. 9 and 10 by phantom lines, is to be fragmented. Concentric rings 79 and 80 of vertical blasting holes are drilled downwardly from room 70 along the length of columnar void 75. A closed square border of vertical blasting holes (not shown in FIGS. 9 and 10) extends around the edge of retort 78. Except for two rings instead of three, the blasting holes are distributed in the manner described and shown above in connection with FIGS. 1 and 2. In one embodiment, columnar void 75 has a diameter of 60 feet, ring 79 has a diameter of 90 feet, and ring 80 has a diameter of 120 feet, the blasting holes of each of rings 79 and 80 are spaced about 15 feet apart and have a diameter of about 6¼ inches. The blasting holes of the square border are spaced about 18 feet apart and have a diameter of about 7½ inches. In the corners, additional 7½ inch blasting holes are provided between ring 80 and the square border along arc segments 15 feet from ring 80. The bottom retort 78 is funnel-shaped so as to improve the distribution of gases flowing into tunnel 76. Thus, the blasting holes of rings 79 are shorter in length than columnar void 75; blasting holes 80 are shorter than holes 79, and holes 81 are shorter than holes 80, so as to provide the desired slope for the bottom of retort 78, but they do not extend a principal portion of the entire height of columnar void 75. Retort 78 is provided with a dome-shaped top. To form the dome-shaped top, a central blasting hole 82 and concentric rings of blasting holes 83 and 84 are drilled upwardly from room 70. The length of these blasting holes vary in accordance with the desired dome shape. The blasting holes in the first or inner ring surrounding central blasting hole 82 are shorter than blasting holes 82. The blasting holes in each concentric ring progressing outwardly are shorter than the blasting holes in the next preceding inner ring. The volume of shale included within the dome-shaped top of retort 78 above room 70 is sufficiently large than that after explosive expansion of the shale, fragmented shale completely fills the volume within room 70 and the dome, thereby providing support for overburden 73. In one embodiment, the distance from the ceiling of room 70 to the top or vertex of the dome is less than about 95% of the smallest linear dimension of room 70, e.g., the side dimension in a room with a square floor plan. Distances greater than about 95% of the smallest linear dimension of room 70 may require a sequential series of blasting steps. To reduce the volume of shale expanded above room 70, a portion of the rubble removed in the course of the formation of room 70 can be returned thereto prior to explosive expansion.

The blasting holes are loaded from room 70 with an explosive, such as ANFO, pillar 77 is explosive fragmented, the explosive in the blasting holes surrounding the columnar void is detonated in an outwardly moving sequence, as described above in connection with FIGS. 1 and 2, and the explosive in the blasting holes extending above the room is detonated, to produce a fragmented permeable mass of shale within retort 78. The shale within retort 78 is then retorted in the manner described above in connection with FIG. 4.

The technique described in connection with FIGS. 9 and 10 is used for fragmentation of retorts of intermediate height because the blasting holes can be drilled in a downward direction with equipment located in room 70, and these blasting holes can be loaded with explosive charge in a downward direction from room 70. In one embodiment, room 70 is about 30 feet high, about 120 feet long, and about 120 feet wide; columnar void 75 is about 60 feet in diameter and about 250 feet in height; tunnels 74 and 76 are about 30 feet high and about 30 feet wide; the void fraction of the portion of retort 78 below room 70 is about 19% and the void fraction of the dome-shaped top including the portion of retort 78 occupied by room 70 is between about 25% to 35%.

C. Above and Below Room

Reference is made to FIGS. 11, 12A, 12B, and 13 for an embodiment of the invention in which the columnar void extends both above and below the room used as access to the retort under construction during preparation for fragmenting. The room divides the retort being formed into a plurality of vertically stacked segments. This embodiment is used for fragmentation of relatively tall retorts, e.g., more than about 300 feet in height. Tunnels 111 and 112 are formed at an upper level of a subterranean deposit containing oil shale seam 110, hereafter designated level A.

A main tunnel 113, branch tunnels 114 and 115, and rooms 116 and 117 are formed at an intermediate level of seam 110, hereafter designed level B. The main tunnel 113 is parallel to and midway between the upper tunnels 111 and 112. In this embodiment, rooms 116 and 117 have a square floor plan and lie on opposite sides of tunnel 113 under tunnels 111 and 112. Rooms 116 and 117 have a square floor plan and lie on opposite sides of tunnel 113 under tunnels 111 and 112, respectively, such that the diagonals of the floor plan of rooms 116 and 117 intersect below tunnels 111 and 112, respectively. The rooms can also have a non-square, rectangular cross-sectional area. In one such embodiment, the side of the room with the longer dimension is parallel to the side of tunnel 113. Branch tunnels 114 and 115 extend at an angle of 45° from main tunnel 113 to rooms 116 and 117, respectively, to facilitate access thereto with large pieces of equipment.

A main tunnel 118 and branch tunnels 119 and 120 are formed at a lower level of seam 110, hereafter designated level C. The lower main tunnel 118 is parallel to and lies below intermediate main tunnel 113. Branch tunnels 119 and 120 extend at an angle of 45° from tunnel 118 for ease of equipment access to a point below tunnel 111 and a point below tunnel 112, respectively. Communication between the ground level and levels A, B, and C is established by one or more shafts or drifts (not shown).

In one embodiment, levels A and C are located near the top and bottom of seam 110, respectively, or at least the workable upper and lower limits thereof. Level B is closer to level A than level C so that the upward drilling and upward chargeloading distance is shorter than the downward distance. Tunnels 111, 112, 113, 114, 115, 118, 119, and 120 are preferably self-supporting, i.e., narrow enough that their roofs do not subside in the absence of support pillars. In one embodiment, tunnels 111, 112, 113, 114, 115, 118, 119 and 120 are about 30 feet high and about 30 feet wide; rooms 116 and 117 are about 120 feet wide, about 120 feet long, and about 30 feet high; the distance from level A to level B is about 200 feet; and the distance from level A to level C is about 570 feet.

A retort 125 having a horizontal cross section coinciding with the floor plan of room 116 is depicted prior to fragmentation by phantom lines, and a retort 126 having a horizontal cross section coinciding with the floor plan of room 117 is depicted after fragmentation by solid lines. A columnar void 128 is formed from the middle of room 116 upwardly to a point spaced slightly under tunnel 111 and downwardly to intercept tunnel 119 by use of the techniques described above in connection with FIGS. 1 through 3. In this embodiment, columnar void 128 is cylindrical with a diameter of about 58 feet. Retort 128 is prepared for fragmentation in the manner described above in connection with the embodiment of FIGS. 1 and 2 or the embodiment of FIGS. 9 and 10. Specifically, annular rings of blasting holes are drilled upwardly and downwardly from room 116 for the full length of columnar void 128. At the bottom of retort 125, the blasting holes are incrementally shorter in length moving outwardly from columnar void 128 so as to provide the desired slope for the funnel-shaped bottom of retort 125. The blasting holes are loaded with an explosive charged, such as ANFO, which is detonated in an outwardly moving sequence to fragment the shale within retort 125 in layers. The detonating sequence is the same for the blasting holes extending upwardly and downwardly from room 116. After fragmentation retort 125 appears as retort 126 in the drawings, which is ready for the retorting process to remove hydrocarbon values from the shale. The former location of room 117 and the columnar void of retort 126 are depicted by phantom lines because they are filled by the fragmented shale created by the explosive expansion. A pillar 137 of unfragmented shale remains between the top of retort 126 and tunnel 112. The fragmented shale fills retrot 126 to the top, thereby serving to support pillar 137, if necessary. A sealed bulkhead 133 is installed in tunnel 115 prior to retorting.

If a very thick shale seam is being worked, it may be desirable to provide more than three levels; specifically, more than one level B would be provided in order to avoid unduly long drilling and charge loading distances. In such case, difficult overhead drilling and charge loading is avoided in all but the highest of the B levels. Thus, at the height of the retort increases and more B levels are added, the less overhead drilling and loading is required, as a percentage of the volume of the retort.

Figure 12B:
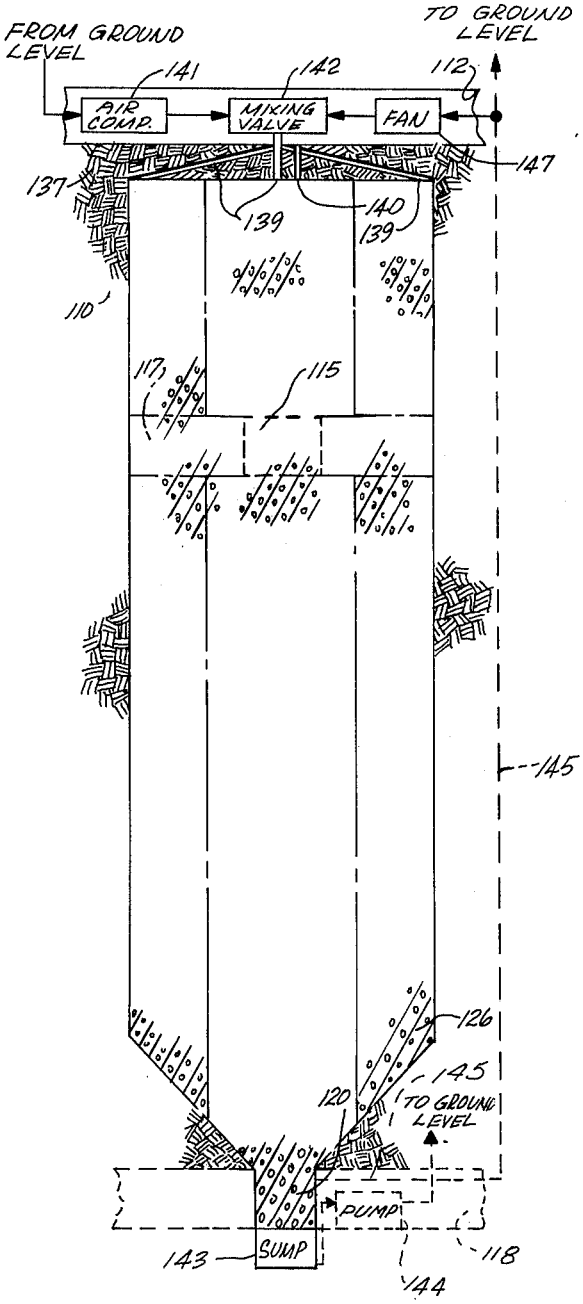
Figure 12A:
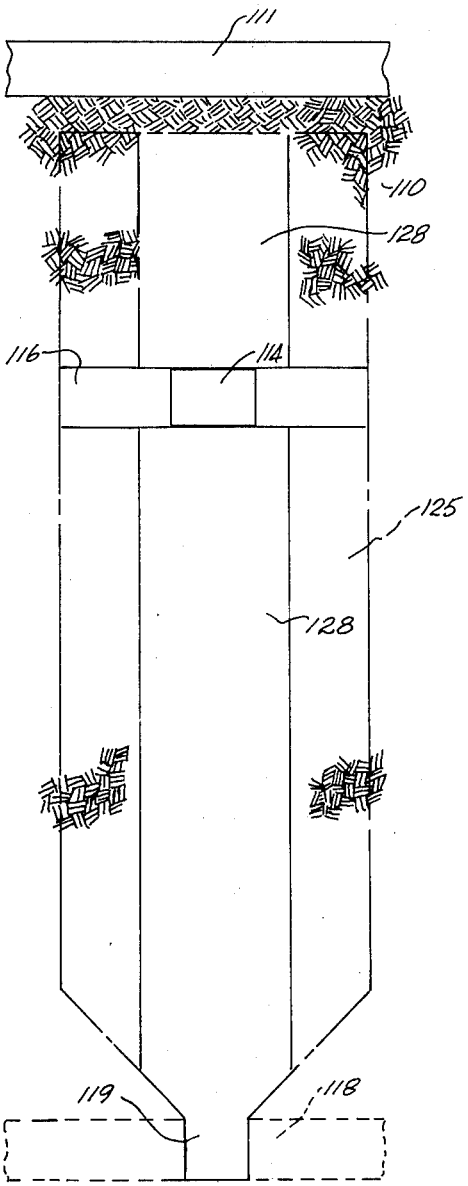

As illustrated in FIG. 12B, a plurality (e.g., five) of gas supply holes 139 are drilled from the upper tunnel 112 to distribution points at the top of retort 126 (e.g., the four corners and the center). In this embodiment, holes 139 have a diameter of 4 to 7 feet. A hole 140 is drilled from tunnel 112 to the top of retort 126. Hole 140 has a diameter of 4 to 10 feet. A burner (not shown) is lowered through hole 140 to the top of retort 126, and fired to ignite the fragmented shale. Ignition of the retort can also be accomplished by inserting a burner through one or more of the gas inlet holes 139 and firing it.

Thereafter, air or other oxidizing gas under pressure is conveyed from an air compressor 141 located in tunnel 112 or at ground level through a mixing valve 142 and holes or conduits 139 to the top of retort 126 to maintain combustion of the oil shale. Mixing valve 142 also has a shut off capability. Air from the atmosphere is conveyed to compressor 141. Tunnel 120 is exposed to the fragmented mass at the bottom of retort 126. A sump 143 is located in tunnel 120 near the low point of retort 126. Depending upon the slope of branch tunnel 120, special grading and/or drainage ditches can be provided prior to the explosive expansion in order to drain the shale oil to sump 143. A pump 144 carries the shale oil from sump 143 to ground level. A conduit 145 carries a portion of the off gases recovered from the retorting process from a sealed bulkhead 146 in tunnel 120 to mixing valve 142 via a fan 147 located in tunnel 112. Alternatively, sump 143 could be located in tunnel 118.

As the fragmented shale in retort 126 burns slowly downwardly, hydrocarbon values comprising liquid shale oil and flue or off gas are released by the heat of combustion. The shale oil percolates downward through retort 126 to tunnel 120, where it collects in sump 143. The off gas is carried down to tunnel 120 by the flow of gas introduced at the top of retort 126 and withdrawn at the bottom from which point it is carried by conduit 145 to fan 147. Some of the off gas is recycled through mixing valve 142 to mix with the air introduced at the top of retort 126. The remainder of these off gases is conducted to ground level by a service shaft (not shown) for utilization. Mixing valve 142 controls the mixture ratio between air and recycled off gas. The mixture of recycled gas and air permeates through retort 126 behind the combustion zone and the released hydrocarbon values permeate through retort 126 in advance of the combustion zone. Thus, retort 126 serves as an in situ report for the production of shale oil.

In one embodiment of the operation of this invention, compressor 141 supplies 16,500 standard cubic feet per minute (scfm) of air, i.e., about 1.14 scfm per square foot of retort cross section, and 12,300 scfm of off gas are recycled, i.e., about 0.86 scfm per square foot of retort cross section, with the result that a total of almost 29,000 scfm of mixed gas flows through valve 142 into the top of the retort, i.e., about 2.00 scfm per square foot of retort cross section. The combustion in the retort generates additional off gas creating a discharge of about 35,000 scfm from the bottom of retort 126, i.e., about 2.43 scfm per square foot of retort cross section, 22,700 scfm of which is conducted to ground level, i.e., about 1.58 scfm per square foot of retort cross section, and the remainder of which is recycled. A retorting rate of approximately 2 feet per day with a daily production of about 450 barrels of shale oil results.

When the burning zone has moved downward to a point near the bottom of retort 126, valve 142 is shut off, thereby terminating the supply of air to the top of retort 126. As a result, the burning gradually extinguishes and the remaining off gases generated in the retort are cooled by the fragmented shale in the region adjacent to the bottom of retort 126.

V. Techniques for Preparing Large Regions

In oil shale recovery operations on a commerical scale, the described techniques are employed to work large oil shale deposits extending over a number of square miles. A mining plan that efficiently utilizes the shale in the deposit and provides ready access to all areas of the deposit is one aspect of a commercial operation.

A. Plural Retorts and Interconnecting Tunnels

Reference is made to FIGS. 14, 15, and 16 for floor plans of levels A, B, and C of a large oil shale deposit, of which FIGS. 11, 12A, 12B, and 13 represent a portion. These floor plans provide a mining layout that permits efficient utilization of the available shale and ready access to the area being worked. The columnar voids employed can be cylindrical or slot-shaped. The walls separating adjacent retorts are of a thickness suffficient to contain the gases in the retort during retorting. Depending on the porosity of the formation, the walls can be from about 10 to about 30 feet or more in thickness.

FIG. 14 depicts level A. Retorts 125 and 126 are arranged in a grid or horizontal rows and columns. In this embodiment, the retorts are shown to have a square cross section; however, they can have a rectangular or other cross section. When of rectangular cross section, a retort can cover an area indicated in FIG. 14 to be covered by two or more retorts. The columnar voids can be cylindrical, or of a slot or other design. When of a slot design, the free faces defining a slot can run parallel to the long or the short side of the rectangular retort, or be otherwise disposed within the retort. Appropriate modifications can be made to the layout of work rooms and tunnels to accommodate a selected retort or columnar void design.

In FIG. 14, six rows of retorts 125 and six rows of retorts 126 are arranged in pairs alternating with each other, and the grid has fourteen columns of retorts 125 and 126. A peripheral tunnel 150 with support pillars 154 extends around and directly above the grid of retorts 125 and 126 in a rectangular path. Main tunnels 111, which extend directly over the respective rows of retort 125, join peripheral tunnel 150 along opposite sides thereof. Similarly, main tunnels 112, which extend directly over the respective rows of retort 126, join peripheral tunnel 150 along opposite sides thereof. At one corner of peripheral tunnel 150, a connecting tunnel 151 leads to a service shaft 152 and a production shaft 153, which extend verticaly downward from ground level to level C. The purpose of level A is to provide access to the top of the retorts for burners that ignite the fragmented oil shale, to convey air under pressure and/or recycled off gas to the top of the burning retorts, and to house the mixing valves that control the ratio of air and off gas introduced into the top of the retorts. In addition, level A can house an electrical generator (not shown) powered by burning the vented off gas after scrubbing and an air compressor driven by the generator. The products of combustion resulting from the burning can be conveyed by production shaft 153 to ground level.

FIG. 15 depicts level B. Rooms 116 and 117, which correspond in floor plan to the horizontal cross section of retorts 125 and 126, respectively, are arranged in a horizontal grid of alternating rows and columns, as described above in connection with FIG. 14. A peripheral tunnel 160 with support pillars 164 extends around the grid of rooms 116 and 117 in a rectangular path. Main tunnels 113, which extend between the respective rows of rooms 116 and 117, join peripheral tunnel 160 along opposite sides thereof. Branch tunnels 114 and 115 connect main tunnels 113 with rooms 116 and 117, respectively. A connecting tunnel 161 leads from one corner of peripheral tunnel 160 to service shaft 152 and production shaft 153. The purpose of level B is to provide access to the retorts in order to form the columnar voids, and to drill and load the blasting holes. The height of the tunnels and rooms at level B is dictated by the space requirements of the equipment employed to perform these operations. In one embodiment, the tunnels are 30 feet wide and 30 feet high.

FIG. 16 depicts level C. Retorts 125 and 126 are arranged in a grid of alternate rows and columns, as described above in connection with FIG. 14. A peripheral tunnel 170 with support pillars 174 extends around and below the grid of retorts 125 and 126. Main tunnels 118 join peripheral tunnel 170 along opposite sides thereof. Branch tunnels 119 and 120 connect main tunnels 118 with the bottom of the columnar void or voids of each retort. A connecting tunnel 171 leads from one corner of peripheral tunnel 170 to service shaft 152 and production shaft 153. The purpose of level C is to remove debris during the formation of columnar void 128, and to remove hydrocarbon values, including shale oil and off gas, during the retorting operation.

In the mining plan illustrated in FIGS. 14 through 16, a portion of retorts 125 and 126 in the rectangular matrix are illustrated. The retorts are not ordinarily all created and retorted together. Instead, retorts are prepared at one corner of the grid and then additional retorts can be prepared in such order that a front of retorts progresses generally diagonally across the grid. With such a grid development technique, retorts formed early in operations can be completely retorted before the final retorts are commenced. At any time, a number of retorts are in progressive stages of mining, fragmenting, igniting, and retorting so that a substantially steady daily production of shale oil is provided for. The columnar voids are not represented in FIGS. 14, 15, and 16.

B. Plural Columnar Vois Extending From Single Room

Reference is made to FIGS. 17, 18, 19, 20, 21A, and 21B for illustrative embodiments employing a plurality of columnar voids extending from a single room. It should be noted that the embodiment of FIGS. 5 through 8 having two slot-shaped columnar voids is also representative of such embodiments. By employinga plurality of columnar voids in a retort having a large horizontal cross section, more uniformity of the permeability and particle size distribution can be achieved than by employing a single columnar void extending from the center of the room. Greater reliability in blasting effectiveness is also achieved.

Figure 17:
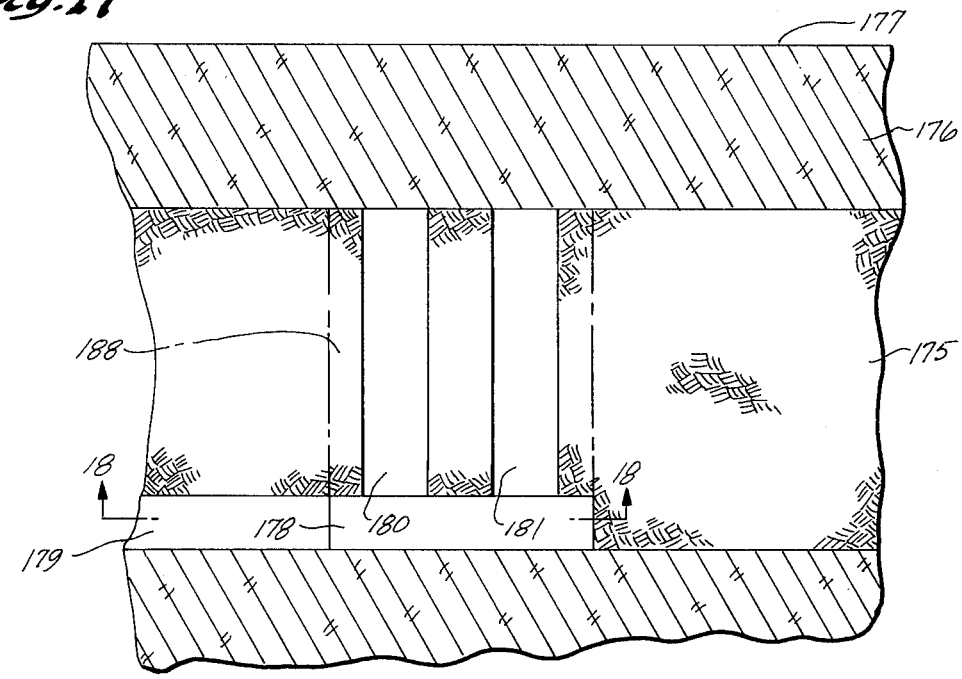
FIGS. 17 and 18 depict another portion of an oil shale seam in which four cylindrical columnar voids are used with a single room to fragment the shale in a retort
Figure 18:
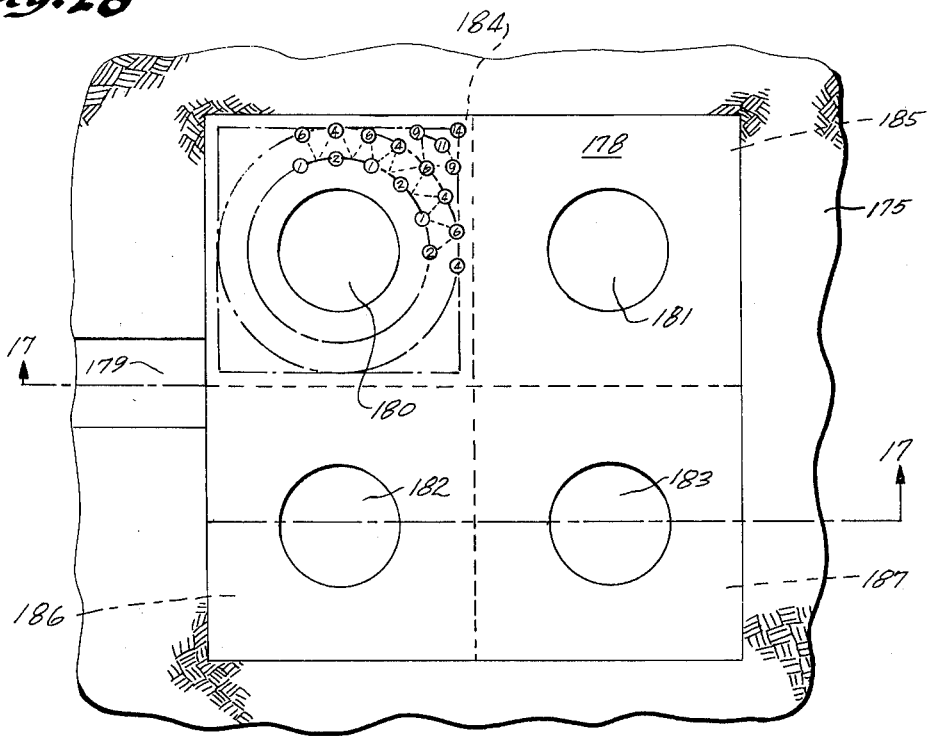

One embodiment, disclosed in FIGS. 17 and 18, depicts a horizontal subterranean oil shale seam 175, an overburden 176, and ground level at 177. A horizontal room 178 having a square floor plan is formed near the bottom of seam 175. A tunnel 179 and a shaft or drift (not shown) connects room 178 to ground level. Four cylindrical columnar voids 180, 181, 182, and 183 extend upwardly from the ceiling of room 178. Columnar voids 180, 181, 182, and 183 pass through the center of regions or quadrants 184, 185, 186, and 187, respectively, each having a square horizontal cross section. Quadrants 184 through 187 are represented by dashed lines in FIG. 18. Columnar voids 180 through 183 are each formed in the manner described above in connection with FIGS. 1 through 3. The shale in a retort 188, represented in FIG. 17 by phantom lines, is to be fragmented for the purpose of recovering shale oil therefrom by an in situ operation. The volume of retort 188 is defined by the area of the floor plan of room 178 and the height of a columnar void plus the height of the room.

As illustrated in FIG. 18 in connection with quadrant 184, vertical blasting holes are drilled upwardly from room 178 along the length of columnar voids 180 through 183. The blasting holes are all loaded with an explosive charge, such an ANFO, from room 178. The explosive charge is detonated to fragment the shale within retort 188. The blasting holes are distributed and the charge therein is sequentially detonated in the manner described above in connection with FIGS. 1 and 2. Preferably, quadrants 184 through 187 are fragmented simultaneously; the charge in the ring of blasting holes closest to each of columnar voids 180 through 183 is first detonated simultaneously the charge in the next closest ring of blasting holes to each of columnar voids 180 through 183 is then detonated, and so on to the edge of the quadrants; the lines of blasting holes between quadrants are detonated at the same time as the holes around the periphery of the retort.

The use of a plurality of columnar voids in a single retort permits the use of smaller columnar voids and fewer rings of blasting holes around each columnar void to fragment the shale within a retort. A lesser overall thickness of burden has to be moved by the explosive towards a free face established by the columnar void. This results in a more uniform permeability in a retort having a large horizontal cross section. In one embodiment, room 178 is about 30 feet high, about 120 feet long, and about 120 feet wide, and each of raises 180 through 183 is about 30 feet in diameter and about 250 feet in height. The blasting holes have a diameter of about 4½ inches. In each quadrant, there are two rings of blasting holes, the inner ring has 17 equally spaced blasting holes and a ring diameter of about 45 feet; the outer ring has 21 equally spaced blasting holes and a ring diameter of about 60 feet; at the corners of each quadrant, one blasting hole is spaced about 1 foot from the corner to accommodate drilling equipment and three blasting holes are arranged between the corner hole and the outer ring on an arc with a radius of about 75 feet.

Just as in the embodiments described above wherein there is a single columnar void in the retort, the room used as a base for operations can be at an upper level, a lower level, and/or an intermediate level relative to the upper and lower ends of the columnar voids. Multiple columnar voids can be formed from such a room and blasting holes prepared and loaded for fragmenting the ore adjacent the columnar voids. Mining plans similar to those of FIGS. 14 through 16 can be used with such retorts.

FIGS. 19 and 20 are horizontal sectional views depicting other embodiments in which a plurality of columnar voids extend from a single elongated, rectangular room at the upper portion of an oil shale seam, the sections being taken through the rooms. In FIG. 19, columnar voids 189, 190, 191, 192, 193, and 194 extend vertically downward from room 195 in a subterranean structure containing an oil shale deposit. In the manner described above, the shale in regions 197, 198, 199, 200, 201, and 202 is blasted to columnar voids 189, 190, 191, 192, 193, and 194, respectively, to fragment the shale in a retort having a horizontal cross section coinciding with room 195. In FIG. 20, columnar voids 203, 204, 205, 206, 207, and 208 extend vertically from a room 209 in an oil shale seam. In the manner descirbed above, the shale in regions 210, 211, 212, 213, 214, and 215 is blasted to columnar void 203, 204, 205, 206, 207, and 208, respectively, to fragment the shale within a retort having a rectangular horizontal cross section coinciding with room 209. In each case, where the retort does not have a square cross section, cylindrical columnar voids are preferably distributed so that at least the regions of shale blasted to them, i.e., regions 197 through 202 and 210 through 215, have square cross sections, so that about the same quantity of shale is inwardly expanded in all directions (from all sides) into each columnar void.

FIG. 21A is a bottom sectional view through a room 216 having vertical unfragmented shale support pillars 217, 218, 219, and 220. Alternatively, the cross section of the retort to be formed can be such that there are one or more pillars in a room. A pattern of cylindrical columnar voids 221 is shown surrounding each of pillars 217 through 220. Alternatively, a pattern of columnar voids of slot design can be employed. The portion of the shale in each of regions 222 is blasted, i.e., expanded toward the free face of a respective columnar void 221 in the manner described above to fragment the shale in a retort having a horizontal cross section coinciding with the floor plan of room 216. Preferably, the ratio of the horizontal cross-sectional area of each of columnar voids 221 to that of its respective region 222 is between10% and 20%. As illustrated in FIG. 21B, which is a horizontal section view taken through any part of the resulting retort, it includes a number of support pillars 217 through 220 of unfragmented shale extending from the bottom of the top of the retort, enveloped by a continuous mass of fragmented shale 223. The walls of the pillars comprise part of the side boundaries in an in situ retort which confine the fragmented shale.

Alternatively, since the retort is filled with fragmented shale which itself supports the overburden, the pillars can be employed in the room during the preparation of the columnar voids and the drilling of the blasting holes. The explosive is so placed that upon detonation all the shale in the retort is fragmented leaving no pillars.

To summarize an exemplary embodiment of the invention, a retort is first prepared in a subterranean oil shale deposit by fragmenting the shale within a region of the deposit and the resulting fragmented region is then operated as an in situ retort to produce hydrocarbon values in the form of shale oil and off gases.

The first step in preparing a retort of one embodiment of this invention is to remove shale at a level of the deposit to form a room having a floor plan substantially coinciding with the horizontal cross section of the retort. If the cross section of the retort to be formed is extensive, support pillars of unfragmented shale can be left in the room. The second step is to form an initial vertical columnar void or voids extending perpendicularly from the plane in which the room is located. The third step is to enlarge the initial columnar void or voids into a final columnar void having a free face toward which shale is to be expanded, a length coinciding with the height of the retort less the height of the room, and a horizontal cross-sectional area that is approximately between 10% and about 40%, and preferably between 10% and 20% of the horizontal cross-sectional area of the section of the retort to be served by such columnar void or voids during retort formation. The greater part of the void fraction of the fragmented shale is determined by the horizontal cross-sectional area of the columnar void or voids relative to the cross section of the retort. The fourth step is to drill from the room blasting holes in a ring, straight line, or other pattern parallel to the free face of the columnar void. When in a ring or straight line pattern, the blasting holes are preferably drilled equidistant from the free face of the columnar void. The holes in different rings or different straight lines are at different distances from the free face. The fifth step is to load the blasting holes with explosive. The sixth and final step is to detonate the charge in the blasting holes in one round in a sequence in successive rings or planes progressing away from the free face so that all of the shale in the region adjacent to the columnar void and destined to fill the section of the retort served by the columnar void, moves inwardly and fragments to fill the space of the columnar void and the space occupied by the shale before detonation, within a time segment insufficient to permit the fragmented shale to fall an appreciable distance due to the pull of gravity. In the case wherein a room is located below the shale that is being expanded, a mass of fragmented shale having high, relatively uniform permeability and reltively small particle size with a relatively small void fraction results.

In an exemplary embodiment for the operation of the oil shale retort, shale at the top of the retort is ignited as described above and an oxidizing gas under pressure, namely, a mixture of air and off gases from the retorting process, is introduced into the top of the retort to sustain combustion of the fragmented shale. As a result, a combustion front moves slowly downward through the retort. Heat from the combustion is transferred to the oil shale in a retorting front below the combustion front. Kerogen in the oil shale is decomposed by the retorting process, releasing shale oil and some hydrocarbon gases. The shale oil percolates down to the bottom of the retort, where it is collected; the off gases from combustion and retorting are carried through the retorting zone by the flow of the oxidizing gas introduced at the top of the retort and removed from the retort. This retorting process continues until the combustion front has proceeded downward to the bottom of the retort.

The described embdiments of the invention are only considered to be preferred and illustrative of the inventive concept; the scope of the invention is not to be restricted to such embodiments. Various and numerous other arrangements of columnar voids and blasting hole patterns can be devised by one skilled in the art without departing from the spirit and scope of this invention. For example, it will be apparent that some of the many aspects and features of the invention disclosed herein can be practiced to advantage independently of other aspects and features. The invention is limited only by the scope of the appended claims.

What is claimed is:

1. A method of recovering shale oil from an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one vertically extending columnar void, the surface of the formation defining such a columnar void providing at least one free face extending vertically through the formation within said boundaries, and leaving a second portion of said formation, which is to be fragmented by expansion toward such a columnar void, within said boundaries and extending away from a said free face;

forming a plurality of blasting holes in said second portion extending substantially parallel to a said free face;

loading explosive into said blasting holes;

detonating said explosive for explosively expanding said second portion toward said columnar void; and retorting the fragmented formation containing oil shale in the in situ retort to recover shale oil and gaseous products therefrom.

2. The method of claim 1, wherein said explosive is detonated in a single round of a sequential series of a plurality of detonations progressing outwardly from a said free face, such that a plurality of segments, including at least one layer of formation parallel to said free face, are expanded sequentially progressing away from a said free face.

3. The method of claim 1, wherein said retorting comprises passing a retorting gas through said retort at a temperature sufficient to bring about retorting of said fragmented formation containing oil shale.

4. The method of claim 1, wherein said retorting comprises:

igniting the formation containing oil shale at the top of said retort and establishing a combustion zone;

introducing a combustion sustaining gas to said retort;

retorting said oil shale in said retort by the transfer of heat from said combustion zone to oil shale in a retorting zone; and collecting and withdrawing the liquid and gaseous retorting products from said retort.

5. The method of claim 1, wherein the surface of the formation defining the columnar void is cylindrical providing a cylindrical vertically extending free face.

6. The method of claim 1, wherein groups of blasting holes are arranged in a plurality of rows parallel to a said free face.

7. The method of claim 1, comprising in addition:

excavating a portion of the formation from within the boundaries of the retort to be formed to form at least one workroom having a floor plan that is approximately coextensive with the horizontal cross section of the retort being formed; and wherein the blasting holes are formed from said room, and the loading step comprises loading the blasting holes from said room.

8. The method of claim 7, wherein a said workroom is located near the bottom of the retort so that said columnar void lies above said workroom.

9. The method of claim 7, wherein a said workroom is located near the top of the retort so that said columnar void lies below said workroom.

10. The method of claim 7, wherein said workroom is located intermediate the top and bottom of said retort being formed.

11. The method of claim 7, comprising, in addition, the step of at least partially filling said workroom with fragmented formation containing oil shale prior to the detonating step.

12. The method of claim 1, in which the blasting holes are formed as a series of groups of blasting holes substantially parallel to a said free face in said second portion; and the explosive is detonated in a single round sequentially with the detonations of explosive in successive groups of blasting holes progressing outwardly from a said free face to explosively expand said second portion toward said columnar void.

13. The method of claim 12, wherein the detonation of the explosive in a group of blasting holes comprises two detonations having a time delay therebetween.

14. A method of recovering shale oil from a subterranean formation containing oil shale, comprising the steps of:

excavating a first portion of said formation from a region in said formation to form a workroom having a floor plan approximately coextensive with the horizontal cross section of the region;

excavating a second portion of said formation from said region to form at least one columnar void therein, the surface of the formation defining said columnar void providing at least one free face extending through said region, leaving a third portion of said formation, which is to be fragmented by expansion toward said columnar void, within said region extending away from a said free face;

drilling, from the workroom, a plurality of blasting holes in said third portion substantially parallel to a said free face and extending for a principal portion of the length of the columnar void;

loading the blasting holes with explosive, from the workroom;

detonating the explosive to explosively expand said third portion toward said columnar void in a single round in a series comprising one or more layers parallel to a said free face to fragment said third portion and to fill with fragmented formation containing oil shale, said columnar void and the space in said region originally occupied by said third portion prior to the expansion; and retorting the fragmented oil shale-containing formation in said region to recover shale oil therefrom.

15. A method of recovering shale oil from an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one vertically extending columnar void, the surface of the formation defining such a columnar void providing at least one free face extending vertically through the formation within said boundaries, and leaving a second portion of said formation, which is to be fragmented by expansion toward such a columnar void, within said boundaries extending away from such a free face;

forming a plurality of blasting holes in said second portion extending substantially parallel to such a free face;

loading explosive into said blasting holes;

detonating said explosive for explosively expanding said second portion toward said columnar void; and wherein the volume of such a columnar void, compared to the combined volume of such a columnar void and of the space occupied by the second portion prior to the expansion, is a. sufficiently small so that the expanded second portion fills such a columnar void and the space in the retort occupied by the second portion prior to the expansion, and b. sufficiently large so that the expanded second portion is fragmented; and retorting the fragmented formation containing oil shale in the in situ retort to recover shale oil and gaseous products therefrom.

16. The method of claim 1, in which said blasting holes are formed as a series of groups of blasting holes parallel to a said free face in said second portion;

and the explosive is detonated sequentially in successive groups of blasting holes in a single round to explosively expand said second portion toward said columnar void.

17. The method of claim 16, wherein said columnar void is a cylindrical columnar void and said series of groups of blasting holes comprise a plurality of rings of blasting holes concentric with said cylindrical columnar void.

18. The method of claim 17, comprising in addition:

excavating a portion of said formation from within the boundaries of the retort to be formed to form a workroom having a floor plan that lies within and coincides approximately with the horizontal cross section of the retort being formed, and wherein the forming and loading steps comprise:

drilling the blasting holes from the workroom; and loading the blasting holes from the workroom.

19. The method of claim 15, wherein said columnar void is a cylindrical columnar void and said second portion is expanded toward said columnar void in a series comprising annular layers concentric with said cylindrical columnar void.

20. A method of recovering shale oil from an in situ oil shale retort in a subterranean formation containing oil shale, said retort having top, bottom, and side boundaries of unfragmented formation and containing fragmented formation containing oil shale therein, comprising the steps of:

excavating a first portion of the formation from within the boundaries of the in situ oil shale retort being formed to form at least one columnar void, the surface of the formation defining the columnar void providing at least one free face extending through the formation within said boundaries, and leaving a second portion of said formation, which is to be fragmented by expansion toward said columnar void, within said boundaries extending away from a said free face;

explosively expanding said second portion toward said columnar void with a single round of explosions in one or more segments, including at least one layer of formation parallel to a said free face, to fragment said second portion and to fill with fragmented formation containing oil shale said columnar void and the space occupied by said second portion prior to the expansion; and wherein the volume of the columnar void is not greater than about 20% of the combined volume of said columnar void and of the space occupied by said second portion prior to the expansion; and retorting the fragmented formation containing oil shale in the in situ retort to recover shale oil and gaseous products therefrom.

21. The method of claim 20, wherein the volume of said columnar void is not less than about 10% of the combined volume of said columnar void and of the space occupied by said second portion prior to the expansion.

22. The method of claim 20, wherein the volume of said columnar void is from about 10% to about 20% of the combined volume of said columnar void and of the space occupied by said second portion prior to the expansion.

23. The method of claim 22, in which the volume of said columnar void is about 15% of the combined volume of said columnar void and of the space occupied by said second portion prior to the expansion.

24. A method of recovering shale oil from in situ oil shale retorts in a subterranean formation containing oil shale, said retorts having top, bottom and side boundaries of unfragmented formation and containing fragmented formation containing oil shale therein, comprising the steps of:

excavating first portions of the subterranean formation to form an access and perimetric tunnel system leading to individual retort sites;

excavating second portions of the subterranean formation at the individual retort sites to form a plurality of workrooms in communication with said tunnel system, arranged in rows and columns, the floor plan of such workrooms having dimensions approximating the dimensions of the retorts to be built using such workrooms;

excavating a third portion of the formation from within the boundaries of the in situ oil shale retorts being formed to form at least one vertically extending columnar void in each such retort being formed, the surface of the formation defining the columnar void providing at least one free face extending vertically through the formation within said boundaries, and leaving a fourth portion of said formation, which is to be fragmented by expansion towards said columnar void, within said boundaries and extending away from a said free face;

explosively expanding said fourth portion toward said columnar void in a single round of explosions in one or more segments, including at least one layer of formation parallel to a said free face to fragment said fourth portion and to fill with fragmented formation containing oil shale said columnar void and the space occupied by said fourth portion prior to the expansion;

retorting the fragmented formation containing oil shale in the retort by passing a retorting fluid therethrough; and removing the retorting products from the bottom of the respective retorts.

25. A method of forming, in a subterranean formation containing oil shale, an in situ oil shale retort having boundaries of unfragmented formation and containing fragmented formation containing oil shale therein, comprising the steps of:

excavating a first portion of the formation contained within the boundaries of the retort being formed to form at least one columnar void, the surface of the formation defining such void providing at least one free face extending vertically through the formation, in the retort being formed, leaving a second portion of said formation which is to be fragmented by expansion toward said columnar void, within said boundaries extending away from a said free face; and explosively expanding said second portion toward a said columnar void with a single round of sequential series of a plurality of explosions progressing outwardly from a said free face such that a series of segments comprising a plurality of vertically extending layers of formation parallel to said free face are expanded sequentially progressing away from a said free face, to fragment said second portion and to fill with fragmented formation containing oil shale said columnar void and the space occupied by said second portion prior to the expansion.

26. The method of claim 25, wherein the volume of the columnar voids is not greater than about 20% of the combined volume of said columnar void and of the space occupied by said second portion prior to the expansion.

27. The method of claim 25, wherein the volume of said columnar void is from about 10% to about 20% of the combined volume of said columnar void and of the space occupied by said second portion prior to the expansion.

28. A method of forming, in a subterranean formation containing oil shale, an in situ oil shale retort having top, bottom and side boundaries of unfragmented formation and containing fragmented formation containing oil shale therein, comprising the steps of:

excavating a first portion of said formation from within the boundaries of the retort to be formed to form a workroom intermediate the top and bottom boundaries, separating the formation in the retort being formed into an upper formation extending upwardly from the workroom and a lower formation extending downwardly from the workroom;

excavating a second and a third portion of the said formation from said upper and lower formation, respectively, to form at least one vertically extending columnar void in each of said upper and lower formation, the surfaces of the formations defining such voids providing free faces extending vertically through said formations, leaving a fourth portion of the formation to be fragmented in said upper formation and a fifith portion of the formation to be fragmented in said lower formation which are to be fragmented by expansion toward said columnar voids, within said boundaries and extending away from said free faces;

the volume of the columnar voids is from about 10% to about 20% of the combined volumes of said columnar voids and of the spaces occupied by said fourth and fifth portions of formation prior to the expansion; and explosively expanding each of the said fourth and fifth portions of the formation toward said columnar voids with a single round of sequential series of a plurality of explosions progressing outwardly from said free faces, such that a series of segments comprising a plurality of layers of formation parallel to said free faces are expanded sequentially progressing away from said free faces, to fragment said fourth and fifth portions and to fill with fragmented formation containing oil shale the columnar voids and the space in the in situ retort originally occupied by said fourth and said fifth portions prior to the expansion.

29. A method of forming, in a subterranean formation containing oil shale, an in situ oil shale retort having top, botom and side boundaries of unfragmented formation and containing fragmented formation containing oil shale therein, comprising the steps of:

excavating a first portion of said formation from within the boundaries of the retort to be formed to form at least one workroom intermediate the top and bottom boundaries having a floor plan approximately coextensive with the cross-sectional dimensions of said retort, dividing the retort being formed into a plurality of sections of formation remaining within the retort;

excavating a second portion of the said formation from at least one section to form at least one vertically extending columnar void in such section, the surface of the formation in the section defining such columnar void providing at least one free face extending vertically through said section, leaving a third portion in such section, which is to be fragmented by expansion towards said columnar void, within said boundaries and extending away from a said free face;

the volume of the columnar void in said section being from about 10% to about 20% of the combined volume of said columnar void and of the space occupied by said third portion prior to the expansion; and explosively expanding said third portion toward said columnar void with a single round of sequential series of a plurality of explosions progressing outwardly from a said free face, such that a series of segments comprising a plurality of layers of formation parallel to a said free face are expanded sequentially progressing away from a said free face, to fragment said third portion and to fill with fragmented formation containing oil shale the columnar void and the space occupied by said third portion prior to the expansion.

30. The method of claim 29 wherein said step of explosively expanding said formations results in addition in the filling of said work room.

31. The method of claim 29 comprising:

at least partially filling said workroom with fragmented shale prior to said explosively expanding step and wherein said step of explosively expanding said formations results in filling the space in said workroom not filled prior thereto.

32. A method of forming, in a subterranean formation containing oil shale, an in situ oil shale retort having top, bottom and side boundaries of unfragmented formation and containing fragmented formation containing oil shale therein, comprising the steps of:

excavating a first portion of the said formation from within the boundaries of the in situ oil shale retort being formed to form at least one vertically extending columnar void, the surface of the formation defining the columnar void providing at least one free face extending vertically through the said formation in the retort being formed, leaving a second portion of said formation, which is to be fragmented by expansion toward said columnar void, within said boundaries extending away from a said free face;

the horizontal cross-sectional area of the columnar void being from about 10% to about 20% of the horizontal cross-sectional area of the space occupied by said first and second portions prior to excavation;

explosively expanding said second portion toward a said free face with a single round of sequential series of a plurality of groups of explosions progressing outwardly from said free face such that a series of segments comprising a plurality of layers of formation parallel to a said free face are expanded sequentially progressing away from a said free face, to fragment said second portion and to fill with fragmented formation containing oil shale the columnar void and the space occupied by said second portion prior to the expansion.

33. The method of claim 32, in which the columnar void has a circular horizontal cross section and the layers of oil shale which are expanded are annular and concentric with the circular columnar void.

34. A method of forming, in a subterranean formation containing oil shale, an in situ oil shale retort having top, bottom and side boundaries of unfragmented formation and containing fragmented formation containing oil shale therein, comprising the steps of:

excavating a first portion of said formation from within the boundaries of the retort to be formed to form a work room;

excavating a second portion of said formation from within the boundaries of the in situ oil shale retort being formed to form at least one vertically extending columnar void therein, the surface of the formation defining the columnar void providing at least one free face extending vertically through the formation in the retort being formed, leaving a third portion of the formation which is to be fragmented by expansion toward said columnar void, within said boundaries extending away from a said free face;

drilling, from the room, a plurality of blasting holes in said third portion substantially parallel to a said free face and extending for a principal portion of the length of said columnar void;

loading the blasting holes from the room with explosive; and detonating the explosive to explosively expand said third portion toward said columnar void in a single round in one or more segments, at least one of which is a layer parallel to said free face to fragment said third portion and to fill with fragmented formation containing oil shale said columnar void and the space in the in situ retort originally occupied by said third portion prior to the expansion.

35. The method of claim 34, in which the room is located above the columnar void.

36. The method of claim 34, in which the room is located below the columnar void.

37. The method of claim 34, in which the room is located intermediate the top and bottom of the columnar void.

38. The method of claim 34, in which the columnar void has a circular horizontal cross section and at least some of the blasting holes are arranged in rings concentric with the columnar void.

39. The method of claim 38, in which the room has a rectangular cross section and some of the blasting holes are arranged to form a rectangular border around the concentric rings of blasting holes.

40. A method of forming, in a subterranean formation containing oil shale, an in situ oil shale retort having top, bottom and side boundaries of unfragmented formation and containing fragmented formation containing oil shale therein, comprising the steps of:

excavating a first portion of said formation from within the boundaries of the in situ oil shale retort to be formed to form a work having a floor plan approximately coextensive with the horizontal cross-section of said retort;

excavating a second portion of said formation from within the boundaries of the in situ oil shale retort being formed to form at least one vertically extending columnar void therein, the surface of the formation defining the columnar void providing at least one free face extending vertically through the formation in the retort being formed, leaving a third portion of the formation which is to be fragmented by expansion toward said columnar void, within said boundaries extending away from a said free face;

drilling, from the room, a plurality of blasting holes in said third portion substantially parallel to a said free face and extending for a principal portion of the length of said columnar void;

loading the blasting holes from the room with explosives; and detonating the explosive to explosively expand said third portion toward said columnar void in a single round in one or more segments, at least one of which is a layer parallel to said free face to fragment said third portion and to fill with fragmented formation containing oil shale said columnar void and the space in the situ retort originally occupied by said third portion prior to the expansion;

wherein the horizontal cross-sectional area of the columnar void, relative to the horizontal cross-sectional area of the space occupied by said second and third portions prior to excavation of said second portion, is a. sufficiently small so that the expanded third portion fills the columnar void and the space in the retort occupied by the third portion prior to the expansion, and b. sufficiently large so that the expanded third portion is fragmented.

41. The method of claim 40, in which the columnar void extends downwardly from the floor of said work room.

42. The method of claim 40, in which the columnar void extends upwardly from the top of said work room.

43. The method of claim 40, in which the work room is located intermediate the top and bottom of the retort being formed and at least one columnar void extends upwardly from the top of said room and downwardly from the floor of said room.

44. A method of forming, in a subterranean formation containing oil shale, an in situ oil shale retort having top, bottom and side boundaries of unfragmented formation and containing fragmented formation containing oil shale therein, comprising the steps of:

excavating a first portion of said formation contained within the boundaries of the in situ oil shale retort being formed to form at least one vertically extending columnar void, the surface of the formation defining the columnar void providing at least one free face extending vertically through said formation in the retort being formed, leaving a second portion of said formation, which is to be fragmented by expansion toward said columnar void, within said boundaries extending away from a said free face;

explosively expanding said second portion toward a said free face with a single round of sequential series of a plurality of groups of explosions progressing outwardly from said free face such that a series of segments comprising a plurality of layers of formation parallel to a said free face are expanded sequentially progressing away from a said free face, to fragment said second portion and to fill with fragmented formation containing oil shale the columnar void andt space occupied by said second portion prior to the expansion; and wherein the time delay between consecutive series of explosions is sufficiently short so that the expansion of the formation in said second portion is completed before the first layer thereof that is expanded into said columnar void has had an opportunity to fall appreciably due to the pull of gravity.

45. The method of claim 44 wherein a group of explosions comprises two sub groups of explosions having a time delay therebetween.

46. The method of claim 45 wherein the horizontal cross-sectional area of the columnar void, relative to the horizontal cross-sectional area of the space occupied by said first and second portions prior to excavation, is a. sufficiently small so that the expanded second portion fills the columnar void and the space in the retort occupied by the second portion prior to the expansion, and b. sufficiently large so that the expanded second portion is fragmented.

47. The method of claim 44, wherein said excavating step comprises excavating said first portion to form at least one cylindrical columnar void and said explosively expanding step comprises expanding said second portion in a series of segments comprising a plurality of annular layers that are coaxial with the cylindrical columnar void.

48. The method of claim 44, in which the horizontal cross-sectional area of the columnar void is from about 10% to about 20% of the horizontal cross-sectional area of the space occupied by said first and second portions prior to said excavation and said expansion, over the major portion of the height of said retort being formed.

49. The method of claim 44, in which the horizontal cross-sectional area of the columnar void is about 15% of the horizontal cross-sectional area of the space occupied by said first and second portions prior to said excavation and said expansion, over the major portion of the height of said retort being formed.

50. The method of claim 44, wherein said excavating step comprises:

first excavating a portion of said formation from within the boundaries of the in situ oil shale retort to be formed to form a work room having a floor plan approximately coextensive with the horizontal cross-section of said retort;

drilling from said room a series of groups of blasting holes at least two of said groups being located along lines parallel to said free face, said lines being spaced apart from a said free face and from each other; and, in addition, loading said blasting holes with explosive from said room.

51. The method of claim 50 wherein said explosively expanding step comprises:

detonating said explosive in a single round sequentially in successive groups of blasting holes progressing outwardly from a said free face with a time delay, for the detonation of successive groups measured from the detonation of the first group, which increases with each successive group progressing outwardly from a said free face, to accomplish said explosive expansion.

52. The method of claim 50, in which the room is located at a point intermediate the ends of the columnar void.

53. A method of forming, in a subterranean formation containing oil shale, an in situ oil shale retort having boundaries of unfragmented formation and containing fragmented formation containing oil shale therein, comprising steps of:

excavating a first portion of said formation from within the boundaries of the retort to be formed to form a work room having a floor plan that is approximately coextensive with the horizontal cross section of the retort being formed;

excavating in the formation means of access to a point underlying the work room;

excavating a second portion of the formation from within the boundaries of the in situ oil shale retort being formed to form at least one vertically extending columnar void, the surface of the formation defining the columnar void providing at least one free face extending vertically through the formation within said boundaries, and leaving a third portion of said formation, which is to be fragmented by expansion towards said columnar void, within said boundaries and extending away from a said free face, and wherein said columar void extends vertically from the means of access to a point spaced from the bottom of the work room, leaving a horizontal pillar of intact shale between the top of the columnar void and the bottom of the work room;

drilling, from the work room, a plurality of blasting holes downwardly into said third portion and parallel to said free face, the blasting holes being distributed throughout said third portion;

loading the blasting holes, from the work room, with explosive; and detonating the explosive to explosively expand and to fragment said third portion and to fill with fragmented formation containing oil shale said columnar void and the space occupied by said third portion prior to the expansion.

54. The method of claim 53, additionally comprising the step of drilling from the work room, a plurality of blasting holes upwardly into the formation above the work room;

loading such blasting holes, from the work room, with explosive; and detonating said explosive in the formation above the work room to explosively expanding it, to fragment it and to fill with fragmented formation the work room and the space occupied by the formation above the work room prior to expansion.

55. The method of claim 54 wherein said drilling step comprises:

drilling, from said work room, a series of a plurality of groups of blasting holes downwardly into said third portion and parallel to said free face, at least one of said groups of blasting holes being located along a plane parallel to a said free face; and wherein said step of detonating the explosive comprises:

detonating the explosive to explosively expand said third portion toward a said columnar void in a single round of a sequential series of a plurality of explosions progressing outwardly from a said free face such that a series of segments comprising a plurality of vertically extending layers of formation parallel to said free face are expanded sequentially progressing away from a said free face, to fragment said third portion and to fill with fragmented formation containing oil shale said columnar void and the space occupied by said second portion prior to the expansion.

56. The method of claim 54, wherein the blasting holes drilled upwardly into the formation above the work room comprise blasting holes of varying length, the blasting hole drilled at about the center thereof being the longest and the blasting holes drilled near the perimeter of the retort being formed being the shortest.

57. A method for forming, in a subterranean formation containing oil shale, a plurality of in situ oil shale retorts having boundaries of unfragmented formation and containing fragmented formation containing oil shale therein, comprising the steps of:

excavating first portions of the subterranean formation to form an access and perimetric tunnel system leading to individual retort sites;

excavating second portions of the subterranean formation at the individual retort sites to form a plurality of work rooms in communication with said tunnel system, arranged in rows and columns, the floor plan of such work rooms having dimensions approximating the dimensions of the retorts to be built using such work rooms;

excavating a third portion of the formation from within the boundaries of the in situ oil shale retorts being formed to form at least one vertically extending columnar void in each such retort being formed, the surface of the formation defining the columnar void providing at least one free face extending vertically through the formation within said boundaries, and leaving a fourth portion of said formation, which is to be fragmented by expansion towards said columnar void, within said boundaries and extending away from a said free face;

explosively expanding said fourth portion toward said columnar void with a single round of explosions in one or more segments, including at least one layer of formation parallel to a said free face, to fragment said fourth portion and to fill with fragmented formation containing oil shale said columnar void and the space occupied by said third portion prior to the expansion.

58. The method of claim 57, wherein said tunnel system comprises a plurality of overlying access tunnels, overlying said retorts being formed, and connecting conduits leading from the overlying access tunnels to the top of the individual retorts and a perimetrical tunnel surrounding and interconnecting the overlying access tunnels.

59. The method of claim 58, wherein said tunnel system comprises a plurality of underlying access tunnels, underlying said retorts being formed, and lower connecting tunnels leading from the underlying access tunnels to the bottoms of the individual retorts being formed and a perimetrical tunnel surrounding and interconnecting the underlying access tunnels.

60. The method of claim 58, wherein said tunnel system comprises a plurality of work room access tunnels, each such work room access tunnel being located between a pair of rows of retort sites at the level at which said work rooms are to be excavated, and branch tunnels leading from said work room access tunnels to said work room areas.

61. The method of claim 57, wherein said work rooms are located intermediate the top and bottom of the retorts being formed.

62. The method of claim 57, wherein said tunnel system comprises a plurality of underlying access tunnels, underlying the retorts being formed, and lower connecting tunnels leading from the underlying access tunnels to the bottoms of the individual retorts being formed and a perimetrical tunnel surrounding and interconnecting the underlying access tunnels.

63. The method of claim 57, wherein said tunnel system comprises a plurality of work room access tunnels, each lying between a pair of rows of work rooms, with branch tunnels interconnecting such access tunnel to the work rooms on both sides thereof.

64. The method of claim 63, in which the branch tunnels extend from the access tunnels at an acute angle.

65. A method of forming, in a subterranean formation containing oil shale, a plurality of in situ oil shale retorts having boundaries of unfragmented formation and containing fragmented formation containing oil shale therein, said retorts being arranged in rows and columns comprising the steps of:

excavating first portions of the subterranean formation to form an access and perimetrical tunnel system leading to individual retort sites comprising a. a plurality of work room access tunnels, each such work room access tunnel being located between a pair of rows of retort sites at the level at which said work rooms are to be excavated, and branch tunnels leading from said work room access tunnels to said work room area, b. a plurality of overlying access tunnels, overlying said retorts being formed, and connecting conduits leading from the overlying access tunnels to the top of the individual retorts and a perimetrical tunnel surrounding and interconnecting the overlying access tunnels, c. a plurality of underlying access tunnels, underlying said retorts being formed and lower connecting tunnels leading from the underlying access tunnels to the bottoms of the individual retorts being formed and a perimetrical tunnel surrounding and interconnecting the underlying access tunnels, excavating second portions of the subterranean formation to form a plurality of work rooms in communication with said branch tunnels, arranged in rows and columns, and located at a level intermediate the top and bottom of the retorts to be formed, the floor plan of such work rooms having dimensions approximating the dimensions of the retorts to be built using such work rooms, and a said work room dividing said formation within said boundaries of said retort to be formed into an upper section and a lower section;

excavating a third portion of the formation from each of said upper and lower sections in a plurality of rooms to form in each section at least one vertically extending columnar void, the surface of the formation defining the columnar void providing at least one free face extending vertically through the formation of said section and leaving, in each section, a fourth portion of said formation, which is to be fragmented by expansion towards said columnar void, within said boundaries and extending away from a said free face; and explosively expanding said fourth portion toward said columnar void in each section in a single round of explosions in one or more segments, including at least one layer of formation parallel to a said free face, to fragment said fourth portion and to fill with fragmented formation containing oil shale said columnar void and the space occupied by said fourth portion prior to the expansion.

66. The method of forming, in a subterranean formation containing oil shale, an in situ oil shale retort having boundaries of unfragmented formation and containing fragmented oil shale therein, comprising the steps of:

excavating a first portion of the formation contained within the boundaries of the retort being formed to leave at least one columnar void that has a first free face extending vertically through the oil shale in the retort being formed, the oil shale remaining within said boundaries including a second portion to be expanded adjacent said first free face;

excavating a third portion of the formation contained within the boundaries of the retort being formed adjacent one end of the first free face to leave a room having a floor plan with a perimeter coinciding approximately with the perimeter of the horizontal cross-sectional area of the retort being formed and a second free face extending transverse to the first free face, the oil shale remaining within said boundaries including a fourth portion to be expanded adjacent said second free face;

explosively expanding the second portion toward said first free face in a single round in one or more layers parallel to said first free face to fragment the second portion; and explosively expanding the fourth portion toward said second free face in a single round to fragment said fourth portion.

67. The method of claim 66, in which the step of explosively expanding the second portion comprises:

drilling from the room a plurality of blasting holes into the second portion parallel to the first free face;

loading the blasting holes with explosive; and detonating the explosive in the blasting holes in a sequence progressing away from the first free face.

68. The method of claim 67, in which the columnar void is cylindrical and the blasting holes are vertical.

69. The method of claim 68, in which at least some of the blasting holes are arranged in rings concentric with the columnar void.

70. The method of claim 69, in which the step of explosively expanding the fourth portion comprises:

drilling from the second free face in the room a plurality of blasting holes into the fourth portion, loading the plurality of blasting holes drilled into the fourth portion with explosive, and detonating the explosive in the plurality of blasting holes drilled into the fourth portion.

71. The method of claim 70, in which the blasting holes drilled into the fourth portion are perpendicular to the second free face.

72. The method of claim 71, in which the plurality of blasting holes drilled into the fourth portion define a dome-shaped region above the room.

73. The method of claim 66 wherein said third portion is excavated prior to excavating said first portion.

74. A method of forming, in a subterranean formation containing oil shale, an in situ oil shale retort having boundaries of the formation and containing fragmented formation containing oil shale therein, comprising the steps of:

excavating a plurality of first portions of the formation from within the boundaries of the in situ oil shale retort being formed to form a plurality of vertically extending columnar voids, the surface of the formation defining each columnar void providing at least one free face extending vertically through the formation within said boundaries, and leaving a plurality of second portions of said formation, which are to be fragmented by expansion toward the columnar voids, within said boundaries and extending away from such free faces; and forming a plurality of blasting holes in each of said second portions extending substantially parallel to such a free face;

loading explosive into said blasting holes; and detonating said explosive for explosively expanding each of said second portions toward a columnar void to form a continuous mass of fragmented formation containing oil shale within said boundaries.

75. The method of claim 74, in which the explosive is denoted so as to explosively expand each of said second portions concurrently.

76. The method of claim 74, in which each of said columnar voids is cylindrical and at least a part of said second portion is explosively expanded in layers annular to the columnar voids.

77. The method of claim 76, wherein the retort has a square horizontal cross section and said excavating step comprises excavating prior to the plurality of columnar voids a portion of the formation from within the boundaries of the retort to be formed to form at least one work room having a floor plan that is approximately coextensive with the horizontal cross section of the retort being formed, the columnar voids being four in number and extending through the center of regions of the retort being formed that have square horizontal cross sections.

78. In a method of recovering shale oil from an in situ oil shale retort in a subterranean formation containing oil shale, said retort having top, bottom and side boundaries of unfragmented formation and containing fragmented formation containing oil shale, retorting fragmented oil shale within the retort to release hydrocarbon values therefrom, in improvement comprising:

providing a tunnel above the retort which is to be formed, excavating a first portion of the formation from within the boundaries of the retort being formed to form at least one vertically elongated columnar void below the tunnel, the surface of the formation defining such void providing at least one free face extending vertically through said formation in the retort being formed, and leaving a second portion of said formation, which is to be fragmented by expansion toward said columnar void within said boundaries and extending away from a said free face;

explosively expanding said second portion toward said columnar void in a single round of a sequential series of a plurality of explosions progressing outwardly from said free face such that a plurality of layers of formation parallel to a said free face are expanded sequentially progressing away from a said free face to fragment said second portion and to fill with fragmented formation containing oil shale the columnar void and the space occupied by the said second portion prior to the expansion; and providing means for the admission of gases from said tunnel to said retort.

79. In a method of recovering shale oil from an in situ oil shale retort in a subterranean formation containing oil shale, said retort having top, bottom and side boundaries of unfragmented formation and containing fragmented formation containing oil shale, retorting the fragmented shale within the retort to release hydrocarbon values therefrom, and removing the hydrocarbon values from the retort, the improvement comprising:

providing a tunnel below the retort which is to be formed, excavating a first portion of the formation from within the boundaries of the retort being formed to form at least one vertically elongated columnar void above the tunnel, the surface of the formation defining such void providing at least one free face extending vertically through said formation in the retort being formed, and leaving a second portion of said formation, which is to be fragmented by expansion toward said columnar void, within said boundaries and extending away from a said free face, and removing said excavated first portion through said tunnel below the retort;

explosively expanding said second portion toward said columnar void in a single round of sequential series of a plurality of explosions progressing outwardly from a said free face such that a series of segments comprising a plurality of layers of formation parallel to a said free face are expanded sequentially progressing away from a said free face to fragment said second portion and to fill with fragmented formation containing oil shale the columnar void and the space occupied by the said second portion prior to the expansion; and removing retorting products from said retort through said tunnel.

80. The method of claim 79, comprising in addition, providing a tunnel above the retort; and providing means for admitting gases from said tunnel above the retort to said retort.

81. In a method of forming, in a subterranean formation containing oil shale, an in situ oil shale retort having end boundaries, at least one of which is non-planar, and side boundaries, by excavating a portion of the formation to form at least one columnar void in the retort being formed, drilling blasting holes distributed throughout the retort being formed, loading the blasting holes with explosive, and detonating the explosive to expand and fragment the formation and form an in situ retort containing fragmented formation containing oil shale, the improvement comprising forming a non-planar boundary at one end of said retort by the following steps:

excavating a first portion of the formation from within the boundaries of the retort being formed to form at least one columnar void therein, the surfaces of the formation defining such void providing at least one free face extending vertically through said formation in the retort being formed, parallel to the side boudaries and over the greater part of the distance between the end boundaries and leaving a second portion of said formation which is to be fragmented by expansion toward said columnar void, within said boundaries and extending away from a said free face; and drilling, in said second portion, blasting holes of varying lengths parallel to a said columnar void with each blasting hole terminating at a point in the retort being formed such that the ends are located on the surface of the non-planar end boundary that is formed upon detonation of explosive loaded in the blasting holes to expand said second portion toward said columnar void, to fragment it and to fill with fragmented formation containing oil shale said columnar void and the space in the situ retort originally occupied by said second portion prior to the expansion.

82. The method of claim 81, in which the non-planar end boundary is funnel-shaped about a cylindrical columnar void and the blasting holes are progressively incrementally shorter in length as the distance from the columnar void increases in said second portion.

83. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one vertically extending columnar void, the surface of the formation defining such a columnar void providing at least one free face extending vertically through the formation within said boundaries, and leaving a second portion of said formation which is to be fragmented by expansion toward such a columnar void within said boundaries and extending away from such a column void;

forming a plurality of blasting holes in said second portion extending substantially parallel to such a free face;

loading explosive in said blasting holes; and denoting said explosive for explosively expanding said second portion toward such a columnar void.

84. The method of claim 83 wherein the volume of such a columnar void, compared to the combined volume of such a columnar void and of the space occupied by the second portion prior to the expansion of the second portion, is a. sufficiently small so that the expanded second portion substantially fills such a columnar void and the space in the retort occupied by the second portion prior to the expansion, and b. sufficiently large so that the expanded second portion is fragmented.

85. The method of claim 83 wherein the explosive is detonated in a single round for explosively expanding said second portion toward such a columnar void.

86. The method of claim 83 wherein said explosive is detonated in a single round of sequential series of detonations.

87. The method of claim 83 wherien said explosive is detonated in a single round of a sequential series of a plurality of groups of detonations.

88. The method of claim 83 wherein the columnar void is substantially cylindrical and the surface of the formation defining the columnar void provides a substantially cylindrical free face.

89. The method of claim 83 comprising in addition:

excavating in a portion of the formation at the site of the retort being formed to form at least one work area;

forming said blasting holes from such a work area; and loading explosive into said blasting holes from such a work area.

90. The method of claim 89 wherein such a work area is formed outside of the boundaries of the retort being formed.

91. The method of claim 89 which such a work area is formed within the boundaries of the retort being formed.

92. The method of claim 89 wherein such a work area is formed above said second portion and said blasting holes are formed to extend vertically in said second portion.

93. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the situ oil shale retort being formed to form at least one vertically extending columnar void, the surface of the formation defining such a columnar void providing at least one free face extending vertically through the formation within said boundaries, and leaving a second portion of said formation which is to be fragmented by expansion toward such a columnar void within said boundaries and extending away from such a columnar void;

forming a plurality of vertically extending blasting holes in said second portion;

loading explosive in said blasting holes; and detonating said explosive for explosively expanding said second portion toward such a columnar void.

94. The method of claim 93 wherein the volume of such a columnar void, compared to the combined volume of such a columnar void and of the space occupied by the second portion prior to the expansion of the second portion, is a. sufficiently small so that the expanded second portion substantially fills such a columnar void and the space in the retort occupied by the second portion prior to the expansion, and b. sufficiently large so that the expanded second portion is fragmented.

95. The method of claim 93 wherein the explosive is detonated in a single round for explosively expanding said second portion toward such a columnar void.

96. The method of claim 93 wherein said explosive is detonated in a single round of a sequential series of detonations.

97. The method of claim 93 wherein said explosive is detonated in a single round of a sequential series of a plurality of groups of detonations.

98. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one vertically extending columnar void, the surface of the formation defining such a columnar void providing at least one free face extending vertically through the formation within said boundaries, and leaving a second portion of said formation which is to be fragmented by expansion toward such a columnar void within said boundaries and extending away from such a columnar void;

forming a plurality of blasting holes in said second portion extending substantially parallel to such a free face;

loading explosive in said blasting holes; and detonating said explosive in a single round of a sequential seris of detonations progressing outwardly from such a free face for explosively expanding said second portion toward such a columnar void.

99. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the insitu oil shale retort being formed to form at least one vertically extending columnar void, the surface of the formation defining such a columnar void providing at least one free face extending vertically through the formation within said boundaries, and leaving a second portion of said formation which is to be fragmented by expansion toward such a columnar void within said boundaries and extending away from such a columnar void;

forming a plurality of vertically extending blasting holes in said second portion;

loading explosive in said blasting holes; and detonating said explosive in a single round of a sequential series of detonations progressing outwardly from such a free face for explosively expanding said second portion toward such a columnar void.

100. A method of forming an in situ oil shale retort in a subterranean formation containing oil shale, said retort having top, bottom, and side boundaries of the formation and containing fragmented formation containing oil shale therein, comprising the steps of:

excavating the first portion of the formation from within the boundaries of the in situ oil shale retort being formed to form at least one substantially cylindrical vertically extending columnar void, the surface of the formation defining such a columnar void providing at least one free face extending vertically through the formation within said boundaries, and leaving a second portion of said formation which is to be fragmented by expansion toward such a columnar void within said boundaries and extending away from such a columnar void;

forming a plurality of vertically extending blasting holes in said second portion;

loading explosive in said blasting holes; and detonating said explosive for explosively expanding said second portion toward such a columnar void.

101. A method of claim 100 wherein a portion of said blasting holes are arranged in a plurality of rings substantially parallel to such a free face.

102. The method of claim 100 wherein a portion of said blasting holes are arranged in a plurality of rings substantially parallel to such a free face and the remainder of said blasting holes are arranged to form a rectangular border around the rings.

103. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one substantially cylindrical vertically extending columnar void, the surface of the formation defining such a columnar void providing at least one free face extending vertically through the formation which is to be fragmented by expansion toward such a columnar void within said boundaries and extending away from such a columnar void;

forming a plurality of vertically extending blasting holes arranged in a plurality of rings substantially parallel to such a free face and to form a rectangular border around the rings in said second portion;

loading explosive in said blasting holes; and detonating in said explosive in a single round of a sequential series of a plurality of groups of detonations progressing outwardly from such a free face with time delays between the detonations of the groups progressing outwardly for explosively expanding said second portion toward such a columnar void.

104. A method of forming, in a subterranean formation containing oil shale, a plurality of in situ shale retorts having boundaries of the formation and containing fragmented formation containing oil shale therein, comprising the steps of:

excavating first portions of the subterranean formation to form an access and perimetric tunnel system wherein access tunnels lead to individual retort sites;

excavating second portions of the subterranean formation to form at least one work area at the site of each the in situ oil shale retorts being formed, such a work area being in communication with said tunnel system;

excavating third portions of the formation from within the boundaries of each of the in situ oil shale retort being formed to form at least one vertically extending columnar void in each such retort being formed, the surface of the formation defining such a columnar void providing at least one free face extending vertically through the formation within said boundaries, and leaving in each such retort being formed a fourth portion of said formation extending away from such a free face which is to be fragmented by expansion toward such a columnar void;

drilling, from such a work area, a plurality of blasting holes in said fourth portion extending substantially parallel to such a free face;

loading explosive into the blasting holes from the work area; and detonating the explosive for explosively expanding said fourth portion toward such a columnar void.

105. The method of claim 104 wherein said tunnel system comprises a plurality of upper access tunnels and connecting conduits leading from the upper access tunnels to the top portions of the individual retorts being formed and an upper perimetric tunnel surrounding and connecting the upper access tunnels.

106. The method of claim 104 wherein said tunnel system comprises a plurality of low er access tunnels and connecting tunnels leading from the lower access tunnels to the bottom portions of the individual retorts being formed and a lower perimetric tunnel surrounding and connecting the lower access tunnels.

107. The method of claim 104 wherein said tunnel system comprises a plurality of work area tunnels and branch tunnels leading from said work area access tunnels to said work areas and a work area perimetric tunnel surrounding and connecting the work area access tunnels.

108. A method of forming, in a subterranean formation containing oil shale, a plurality of in situ oil shale retorts having boundaries of the formation and containing fragmented formation containing oil shale therein, comprising the steps of:

excavating first portions of the subterranean formation to form an access and perimetric tunnel system comprising;

a. a plurality of upper access tunnels at a level in the formation above the retorts being formed and connecting conduits leading from the upper access tunnels to the tops of the individual retorts being formed and an upper perimetric tunnel surrounding and connecting the upper access tunnels, b. a plurality of lower access tunnels at a level below the retorts being formed and connecting tunnels leading from the lower access tunnels to the bottoms of the individual retorts being formed and a lower perimetric tunnel surrounding and connecting the lower access tunnels, c. a plurality of work area access tunnels and branch tunnels leading from said work area access tunnels to work areas to be formed and a work area perimetric tunnel surrounding and connecting the work area access tunnels;

excavating second portions of the subterranean formation to form at least one work area, within the boudaries of each of the in situ oil shale retorts being formed, in communication with said tunnel system;

excavating third portions of the formation from within the boundaries of the in situ oil shale retorts being formed to form at least one vertically extending columnar void in each such retort being formed, the surface of the formation defining such a columnar void providing at least one free face extending vertically through the formation within said boundaries, and leaving in each such retort being formed a fourth portion of said formation, extending away from such a free face, which is to be fragmented by expansion toward such a columnar void;

drilling, from such a work area, a plurality of blasting holes in said fourth portion extending substantially parallel to such a free face;

loading explosive into the blasting holes from the work area; and detonating the explosive for explosively expanding said fourth portion toward such a columnar void.

109. A method of forming, in a subterranean formation containing oil shale, an in situ shale retort containing fragmented formation containing oil shale therein, comprising the steps of:

excavating a first portion of said formation at the site of the in situ oil shale retort being formed to form a work area;

excavating a second portion of said formation, to form a means of access to a point underlying the work area;

excavating a third portion of the formation from within the boundaries of the in situ oil shale retort being formed to form at least one vertically extending columnar void having communication with the access means, the surface of the formation defining such a columnar void providing at least one free face extending vertically through the formation within said boudnaries, and leaving a fourth portion of said formation, which is to be fragmented by expansion toward such a columnar void, within said boundaries and extending away from such a free face, and wherein such a columnar void extends downwardly from a level spaced from the bottom of the work area, leaving a horizontal pillar of intact formation between the top of such a columnar void and the bottom of the work area, wherein the access means is utilized in excavating said third portion;

drilling, from the work area, a plurality of blasting holes in said fourth portion extending substantially parallel to such a free face;

loading explosive into the blasting holes from the work area; an detonating the explosive to explosively expand said fourth portion toward such a columnar void.

110. The method of claim 109 wherein the horizontal pillar of intact formation between the top of such a columnar void and the bottom of the work area is explosively expanded during the formation of the in situ oil shale retort.

111. The method of claim 109 additionally comprising the steps of:

drilling, from the work area, a plurality of blasting holes upwardly into the formation above the work area;

loading explosive into such blasting holes from the work area; and detonating said explosive in the formation above the work area to explosively expand it toward the work area.

* * * * *

UNITED STATES PATENT AND TRADEMARK OFFICE

CERTIFICATE OF CORRECTION

PATENT NO. : 4,043,595

DATED : August 23, 1977

INVENTOR(S) : Gordon B. French

It is certified that error appears in the above-identified patent and that said Letters Patent are hereby corrected as shown below:

Column 1, line 18, kerogen" should be -- "kerogen" --.

Column 5, lines 45 and 46 should read -- the retort. If there are unfragmented regions left in the retort, e.g., for support pillars or the like, the percentages would be less. --

Column 10, line 35, -- 50 -- should be inserted after "retort" and before "is".

Column 11, line 28, "empoloyed" should be -- employed --;

line 37, "blasing" should be -- blasting --;

line 53, "blastin" should be -- blasting --.

Column 13, line 57, "visually" should be - usually --.

Column 14, line 58, "coniciding" should be -- coinciding --.

Column 15, line 9, "tunnesl" should be -- tunnels --;

line 61, "onedirectional" should be -- one-directional --.

UNITED STATES PATENT AND TRADEMARK OFFICE

CERTIFICATE OF CORRECTION

PATENT NO. : 4,043,595

DATED : August 23, 1977

INVENTOR(S) : Gordon B. French

It is certified that error appears in the above-identified patent and that said Letters Patent are hereby corrected as shown below:

Column 16, line 12, "vertidal" should be --vertical--;
line 13, "536,607" should be -- 563,607 --;
line 57, "vertial" should be -- vertical --;
line 68, "and" should be -- through --.

Column 17, line 19, "heigh" should be -- height --;
line 32, "and" should be -- through --;
line 34, "and" should be -- through --.

Column 18, line 18, "one" should be -- the --;
line 56, "74" should be -- 75 --.

Column 21, line 26, "charged" should be -- charge --;
line 39, "retrot" should be -- retort --;
line 48, "at" should be -- as --.

Column 22, line 32, "report" should be -- retort --.

UNITED STATES PATENT AND TRADEMARK OFFICE

CERTIFICATE OF CORRECTION

PATENT NO. : 4,043,595

DATED : August 23, 1977

INVENTOR(S) : Gordon B. French

It is certified that error appears in the above-identified patent and that said Letters Patent are hereby corrected as shown below:

Column 23, line 5, "suffficient" should be -- sufficient --;
line 38, "verticaly" should be -- vertically --.

Column 24, line 32, "Vois" should be -- Voids --;
line 39, "employinga" should be -- employing a --;
line 63, -- retorting -- should be inserted after "in situ" and before "operation".

Column 27, line 17, "reltively" should be -- relatively --;
line 39, "embdiments" should be -- embodiments --.

Column 31, line 25, "the" (second occurrence) should be -- each of such --.

Column 32, line 61, "botom" should be -- bottom --.

Column 34, line 62, -- room -- should be inserted after "work" and before "having".

Column 36, line 1, "andt" should be -- and the --;
line 61, -- as --should be inserted after "groups" and before "measured".

UNITED STATES PATENT AND TRADEMARK OFFICE

CERTIFICATE OF CORRECTION

PATENT NO. : 4,043,595

DATED : August 23, 1977

INVENTOR(S) : Gordon B. French

It is certified that error appears in the above-identified patent and that said Letters Patent are hereby corrected as shown below:

Column 37, line 55, -- a -- should be inserted after "to" and before "said".

Column 39, line 29, "area" should be -- areas --.

Column 41, line 19, "denoted" should be -- detonated --;

line 58, -- a -- should be inserted after "from" and before "said".

Column 42, line 54, "surfaces" should be -- surface --.

Column 44, line 1, "which" should be -- wherein --.

Column 45, line 11, "insitu" should be -- in situ --.

Column 46, line 2, -- within said boundaries, and leaving a second portion of said formation -- should be inserted after "formation" and before "which";

line 10, "in" (first occurrence) should be deleted.

UNITED STATES PATENT AND TRADEMARK OFFICE

CERTIFICATE OF CORRECTION

PATENT NO. : 4,043,595

DATED : August 23, 1977

INVENTOR(S) : Gordon B. French

It is certified that error appears in the above-identified patent and that said Letters Patent are hereby corrected as shown below:

Column 46, line 17, --oil -- should be inserted after "in situ" and before "shale";

line 58, "low er" should be -- lower --;

line 64, -- access -- should be inserted after "area" and before "tunnels".

Column 47, line 30, "boudaries" should be -- boundaries --.

Column 48, line 18, "boudnaries" should be -- boundaries --;

line 33, "an" should be -- and --.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*